US006918816B2

(12) United States Patent
Bianchi

(10) Patent No.: US 6,918,816 B2
(45) Date of Patent: Jul. 19, 2005

(54) APPARATUS AND METHOD FOR POLISHING A FIBER OPTIC CONNECTOR

(75) Inventor: Robert J. Bianchi, Minneapolis, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 10/356,358

(22) Filed: Jan. 31, 2003

(65) Prior Publication Data

US 2004/0152399 A1 Aug. 5, 2004

(51) Int. Cl.[7] ..... B24B 49/00
(52) U.S. Cl. ..... 451/11; 451/168; 451/173
(58) Field of Search ..... 451/11, 168, 170, 451/171, 173, 312, 313, 317

(56) References Cited

U.S. PATENT DOCUMENTS

| | | | |
|---|---|---|---|
| 2,577,312 | A | 12/1951 | Donahue |
| 3,868,794 | A | 3/1975 | Zitkus |
| 4,291,502 | A | 9/1981 | Grimsby et al. |

(Continued)

FOREIGN PATENT DOCUMENTS

| | | | |
|---|---|---|---|
| DE | 40 04 665 | A1 | 8/1991 |
| DE | 197 52 228 | A1 | 5/1998 |
| EP | 0 579 056 | A1 | 1/1994 |

(Continued)

OTHER PUBLICATIONS

"ADC FasTerm™ Multimode LX.5™ Connector Installation Instructions," *ADC Telecommunications, Inc.*, Issue 2, pp. 1–25 (Apr. 2001).
"Universal Type 12–Axis Optical Fiber Polisher SFP–510," *JPS Optics Inc.*, 4 pages (1989).
"ADC FasTerm® Singlemode UPC and Multimode LX.5® Connector Installation Instructions," *ADC Telecommunications, Inc.*, Issue 2, pp. 1–26 (May 2002).
"Fiber Optic," *Nanometer Technologies*, 1 page (visited May 24, 2004).

(Continued)

*Primary Examiner*—M. Rachuba
(74) *Attorney, Agent, or Firm*—Merchant & Gould P.C.

(57) ABSTRACT

A fiber optic polishing apparatus including a support system, a polishing sub-assembly coupled to the support system including a plurality of pads, and a fixture to hold a plurality of fiber optic connectors. The fixture is positioned adjacent to the plurality of pads so that an end surface of each of the plurality of fiber optic connectors is held in contact with a corresponding pad. A drive mechanism is coupled to the support system to move the fixture to polish the end surface of each of the plurality of fiber optic connectors. Each of the plurality of pads may travel independently in a vertical direction. The polishing sub-assembly may further include a web polishing film, a fluid injection module configured to direct water onto the film, and a rinsing module to rub against a face of each of the plurality of fiber optic connectors to remove debris.

15 Claims, 42 Drawing Sheets

U.S. PATENT DOCUMENTS

| | | | | | |
|---|---|---|---|---|---|
| 4,498,260 | A | | 2/1985 | Doty | |
| 4,587,768 | A | | 5/1986 | Doyle | |
| 4,649,670 | A | | 3/1987 | Snyder | |
| 4,693,035 | A | | 9/1987 | Doyle | |
| 4,709,512 | A | | 12/1987 | Okubo et al. | |
| 4,802,680 | A | | 2/1989 | Fuchs | |
| 4,819,386 | A | | 4/1989 | Struyf | |
| 4,831,784 | A | | 5/1989 | Takahashi | |
| 4,850,152 | A | | 7/1989 | Heynacher et al. | |
| 4,891,916 | A | | 1/1990 | Rhoades et al. | |
| 4,905,415 | A | * | 3/1990 | Moulin | 451/276 |
| 4,979,334 | A | | 12/1990 | Takahashi | |
| 5,107,627 | A | | 4/1992 | Mock, Jr. et al. | |
| 5,136,820 | A | | 8/1992 | Luther | |
| 5,184,433 | A | | 2/1993 | Maack | |
| 5,201,148 | A | | 4/1993 | Rupert et al. | |
| 5,216,846 | A | | 6/1993 | Takahashi | |
| 5,218,786 | A | | 6/1993 | Takahashi | |
| 5,265,381 | A | | 11/1993 | Takahashi | |
| 5,281,884 | A | | 1/1994 | Basavanhally et al. | |
| 5,321,917 | A | | 6/1994 | Franklin et al. | |
| 5,345,323 | A | | 9/1994 | Basavanhally et al. | |
| 5,349,784 | A | | 9/1994 | Grois et al. | |
| 5,351,445 | A | | 10/1994 | Takahashi | |
| 5,403,227 | A | * | 4/1995 | Franklin et al. | 451/168 |
| 5,447,464 | A | | 9/1995 | Franklin et al. | |
| 5,458,528 | A | | 10/1995 | Lurie et al. | |
| 5,458,531 | A | | 10/1995 | Matsuoka et al. | |
| 5,461,689 | A | | 10/1995 | Matsuoka et al. | |
| 5,516,328 | A | | 5/1996 | Kawada | |
| 5,547,418 | A | | 8/1996 | Takahashi | |
| 5,556,323 | A | | 9/1996 | Luther et al. | |
| 5,559,916 | A | | 9/1996 | Terao et al. | |
| 5,601,474 | A | | 2/1997 | Takahashi | |
| 5,643,064 | A | | 7/1997 | Grinderslev et al. | |
| 5,667,426 | A | | 9/1997 | Minami et al. | |
| 5,674,114 | A | | 10/1997 | Miller et al. | |
| 5,711,701 | A | | 1/1998 | Grinderslev et al. | |
| 5,720,653 | A | | 2/1998 | Miller et al. | |
| 5,741,171 | A | | 4/1998 | Sarfaty et al. | |
| 5,743,787 | A | | 4/1998 | Ishiyama et al. | |
| 5,778,125 | A | * | 7/1998 | Busse et al. | 385/80 |
| 5,813,902 | A | | 9/1998 | Wiegand | |
| 5,947,797 | A | | 9/1999 | Buzzetti | |
| 6,077,154 | A | | 6/2000 | Takashi et al. | |
| 6,106,368 | A | | 8/2000 | Childers et al. | |
| 6,110,013 | A | | 8/2000 | Minami et al. | |
| 6,113,469 | A | | 9/2000 | Yoshikawa et al. | |
| 6,126,519 | A | | 10/2000 | Minami et al. | |
| 6,157,863 | A | | 12/2000 | Chandler et al. | |
| 6,165,055 | A | | 12/2000 | Takahashi et al. | |
| 6,183,343 | B1 | | 2/2001 | Buzzetti | |
| 6,190,239 | B1 | | 2/2001 | Buzzetti | |
| 6,257,971 | B1 | | 7/2001 | Takahashi et al. | |
| 6,276,842 | B1 | | 8/2001 | Xu et al. | |
| 6,280,293 | B1 | | 8/2001 | Minami et al. | |
| 6,302,763 | B1 | | 10/2001 | Buzzetti | |
| 6,347,974 | B1 | | 2/2002 | Chandler et al. | |
| 6,396,996 | B1 | | 5/2002 | Carpenter et al. | |
| 6,641,472 | B2 | * | 11/2003 | Boyer et al. | 451/526 |
| 6,752,536 | B2 | * | 6/2004 | Boyer et al. | 385/60 |
| 2001/0023164 | A1 | | 9/2001 | Minami et al. | |
| 2002/0160700 | A1 | | 10/2002 | Boyer et al. | |

FOREIGN PATENT DOCUMENTS

| | | |
|---|---|---|
| EP | 0 621 107 A1 | 10/1994 |
| JP | 59-161256 | 9/1984 |
| JP | 60-217055 | 10/1985 |
| JP | 61-113005 | 5/1986 |
| JP | 63-283854 | 11/1988 |
| JP | 63-316811 | 12/1988 |
| JP | 5-19140 | 1/1993 |
| JP | 5-157941 | 6/1993 |
| JP | 5-164942 | 6/1993 |
| JP | 6-138343 | 5/1994 |
| SU | 738825 | 6/1980 |

OTHER PUBLICATIONS

"MCP 24 Advantages and Specs," *Nanometer Technologies*, 1 page (visited May 24, 2004).
"MCP 24 Figure 8 Polishing," *Nanometer Technologies*, 1 page (visited May 24, 2004).
"MCP 24 Fixture Plates," *Nanometer Technologies*, 1 page (visited May 24, 2004).
"MCP 24 Fixture Plates," *Nanometer Technologies*, 1 page (2004).
"MCP 24 Mass Connector Polisher," *Nanometer Technologies*, 1 page (2004).
"MCP 24 Mass Connector Polisher—Technical Information," *Nanometer Technologies*, 1 page (2004).
"MCP 24 Universal Polishing Fixture," *Nanometer Technologies*, 1 page (visited May 24, 2004).
"SFP–550," *Seikoh Giken USA*, 2 pages (2004).

* cited by examiner

APPARATUS AND METHOD FOR POLISHING A FIBER OPTIC CONNECTOR

FIELD OF THE INVENTION

The present invention relates generally to an apparatus and method for manufacturing fiber optic connectors. More particularly, the present invention relates to an apparatus and method for polishing fiber optic connectors to improve the performance characteristics of the connectors.

BACKGROUND OF THE INVENTION

Fiber optic connectors are used to terminate the ends of fiber optic cables. There are many different fiber optic connector types. Example types of fiber optic connectors include FC-type, SC-type, ST-type and D4-type.

FIG. 1 shows a typical connector 10. A ferrule 12 is located inside the connector 10. The ferrule 12 is a relatively long, thin cylinder preferably made of a material such as ceramic. Other materials such as metal or plastic can also be used to make the ferrule 12. The ferrule 12 defines a central opening 14 sized to receive a fiber 16 of a given cladding diameter. An epoxy is typically placed into the opening 14 prior to inserting the fiber 16 to hold the fiber 16 in place. The ferrule 12 functions to align and center the fiber 16, as well as to protect it from damage.

Referring still to FIG. 1, the ferrule 12 is supported within a connector body 18 typically made of a material such as metal or plastic. The connector body 18 is typically bonded to fiber optic cable 20 (e.g., the cable 20 can include a reinforcing layer made of a material such as Kevlar that is affixed to the connector 18). A strain relief boot 22 protects the junction between the connector 18 and the cable 20. Two connectors are preferably interconnected through the use of an adapter 24. Adapter 24 includes a sleeve 26 sized to receive the ferrules of the connectors desired to be connected. For example, ferrule 12 of connector 10 is inserted into a first end 28 of the sleeve 26, while a ferrule (not shown) of a connector desired to be connected to the connector 10 is inserted into a second end 30 of the sleeve 26. As so inserted, the ends of the ferrules abut one another within the sleeve 26 such that their corresponding fibers are held in alignment with one another.

It is desirable to minimize the loss of signals passing through the fiber. Parameters for evaluating the performance of a connector include insertion loss and return loss. Insertion loss is the measurement of the amount of power that is transferred through a coupling from an input fiber to an output fiber. Return loss is the measurement of the amount of power that is reflected back into the input fiber. To enhance signal quality and therefore optimize insertion/return loss, it is desirable to polish an end face 13 of the ferrule 12. During the polishing process, the ferrule 12 is commonly held in a fixture, and the end 13 is pressed against an oscillating and rotating disk. Frequently, the end 13 is polished to form a spherical polished surface oriented along a plane that is perpendicular with respect to the longitudinal axis of the fiber 16. However, for some applications, the end 13 is polished to form a spherical surface aligned at an oblique angle with respect to the longitudinal axis of the fiber 13.

FIG. 2 is a block diagram showing the steps of a convention ferrule polishing technique for providing a rounded ferrule tip. During a first polishing step 70, a hackle of the fiber and residue epoxy are removed from the ferrule tip typically by a hand-sanding process or automated system such as an epoxy removal machine. After the hackle and epoxy have been removed, the tip of the ferrule is machine polished using two or more polishing films (e.g., of varying coarseness) so as to more precisely form an apex and radius into the tip of the ferrule (see step 72). Next, the tip of the ferrule is machine polished with a final polish film as indicated by step 74. During the polishing process, an index layer is formed at the tip of the fiber within the ferrule. The index layer has undesirable optical properties. Thus, at final step 76, the tip of the ferrule is polished with a cerium oxide film causing the fiber to be recessed slightly into the ferrule a distance sufficient to remove the index layer. For some applications, the tip is recessed prior to the final polish, as disclosed, for example, in U.S. patent application Ser. No. 10/071,856, filed Feb. 8, 2002, which is hereby incorporated by reference.

SUMMARY OF THE INVENTION

One aspect of the present invention relates to a fiber optic connector polishing apparatus and method for polishing fiber optic connectors to improve the performance characteristics of the connectors.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

Figure 1:
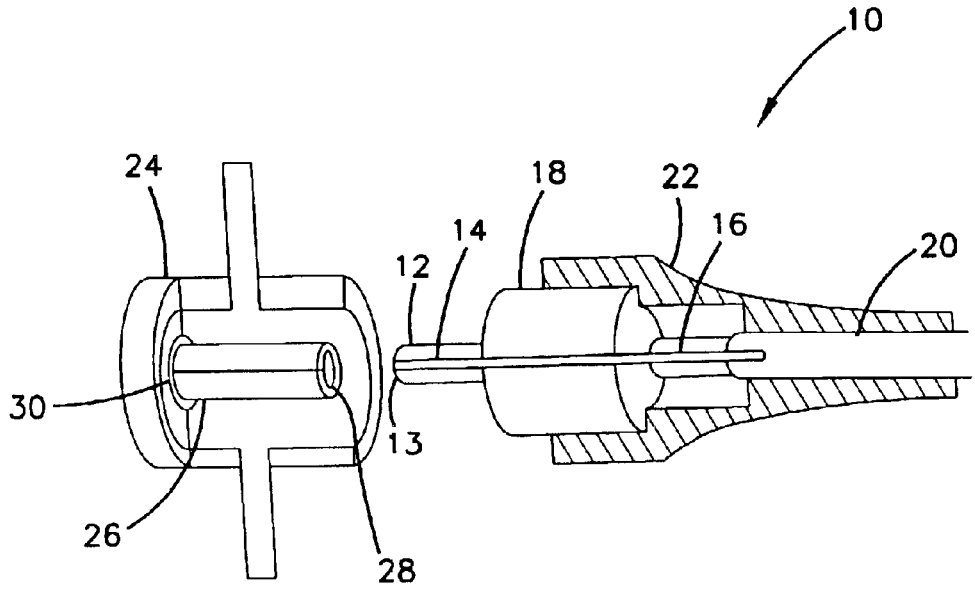
FIG. 1 (Prior Art)
FIG. 1 illustrates a typical prior art connector.
Figure 2:
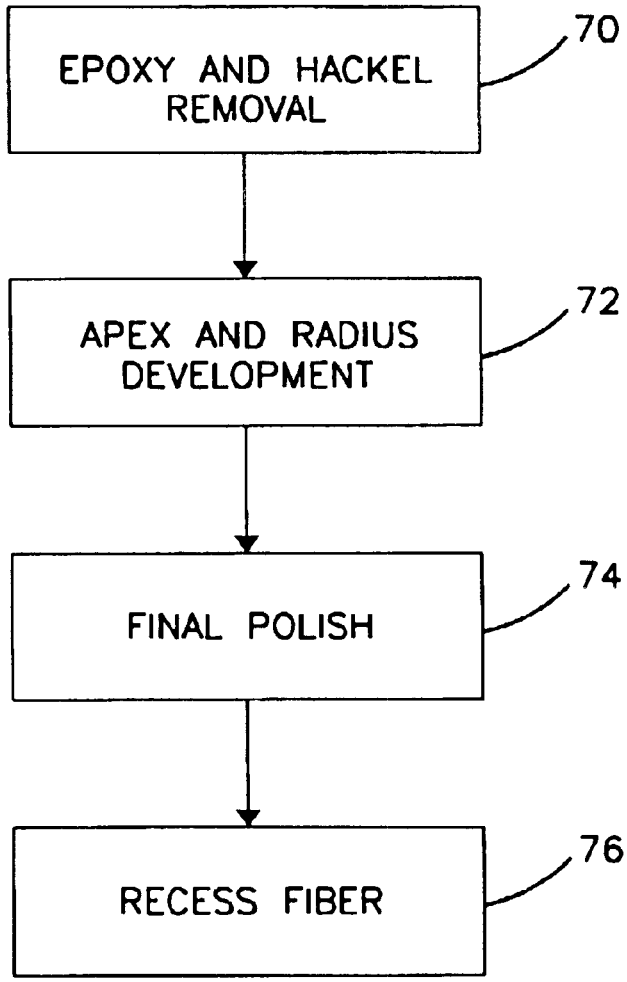
FIG. 2 (Prior Art)
FIG. 2 illustrates a prior art polishing technique.
Figure 3:
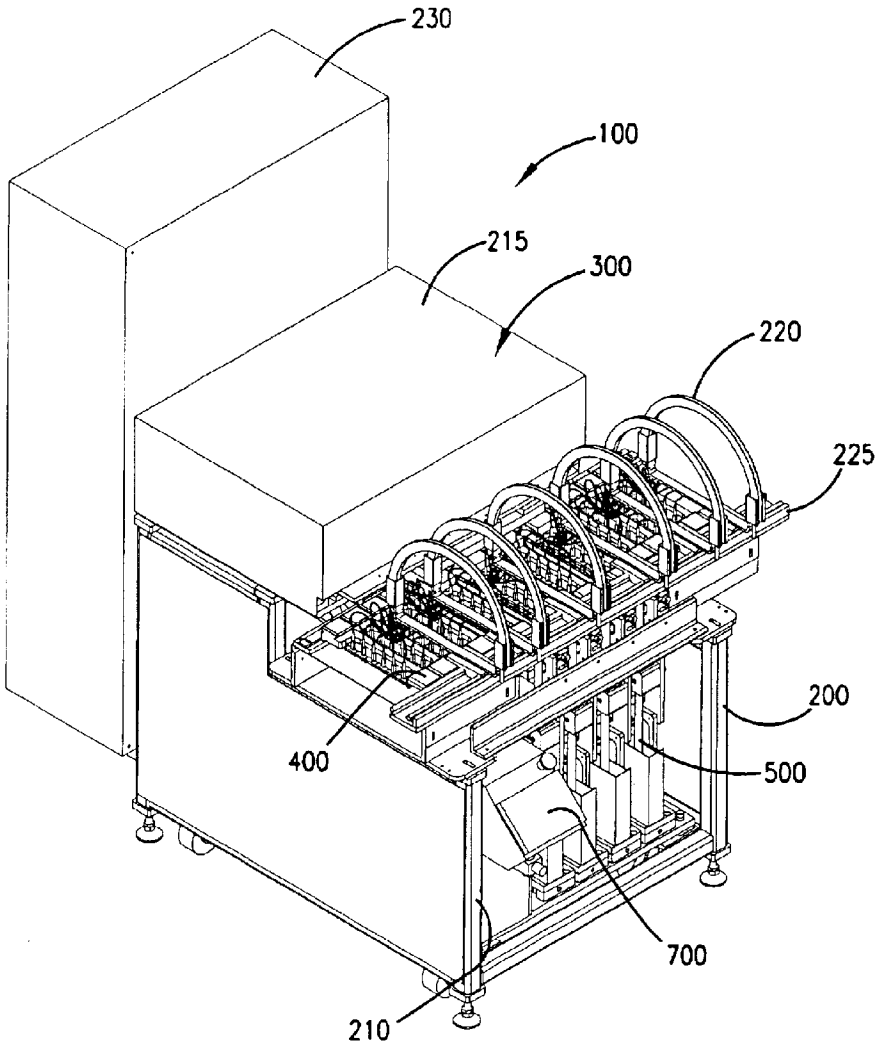
FIG. 3 is a perspective plan view of an example embodiment of a polishing apparatus made in accordance with the present invention.
Figure 4:
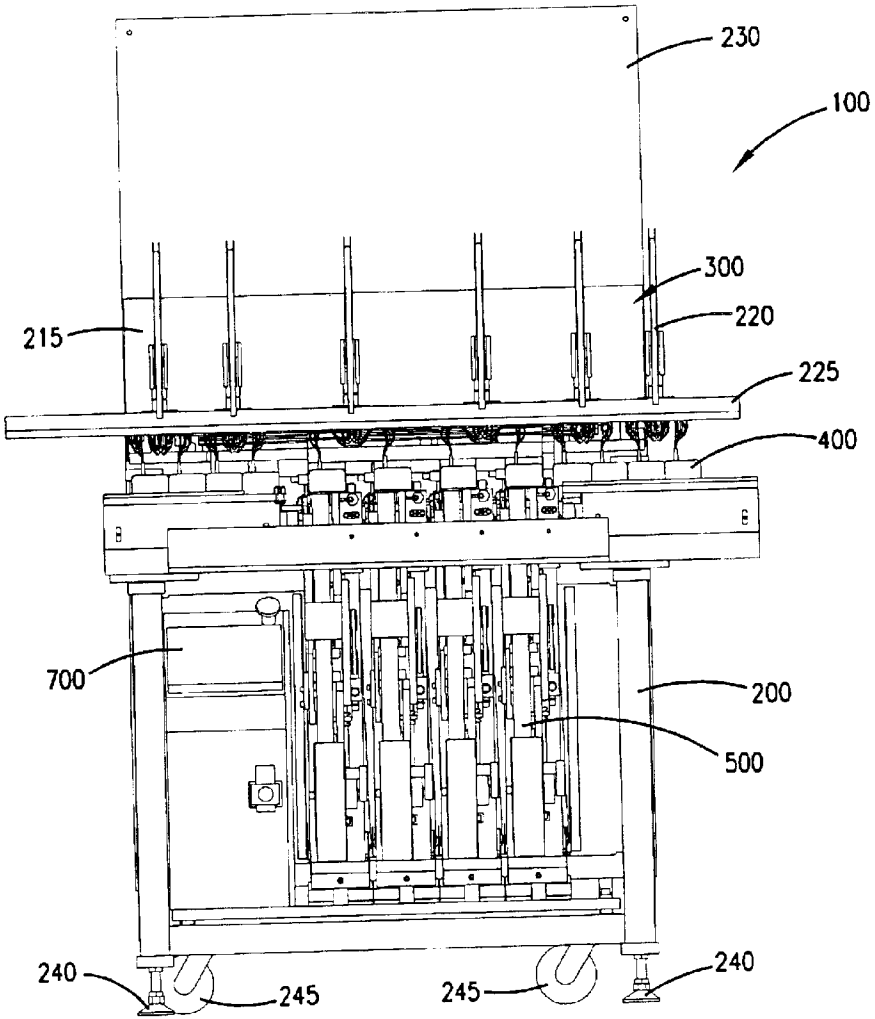
FIG. 4 is front view of the example polishing apparatus of FIG. 3.

While the invention is amenable to various modifications and alternative forms, the specifics there have been shown by way of example in the drawings and will be described in detail below. It is to be understood, however, that the intention is not to limit the invention to a particular embodiment. On the contrary, the intention is to cover all modifications, equivalents and alternatives falling within the scope of the invention as defined by the appended claims.

DETAILED DESCRIPTION

In the following detailed description, references are made to the accompanying drawings that depict various embodiments which are examples of how inventive concepts in accordance with the principles of the present disclosure may be practiced. It is to be understood that other embodiments may be utilized, and that structural and functional changes may be made without departing from the scope of the present invention.

The disclosure generally relates to a polishing apparatus for polishing end faces of fiber optic connectors (e.g. end face 13 of the fiber optic connector 10 of FIG. 1), such as the example embodiment of a polishing apparatus 100 as shown in FIGS. 3–6. The polishing apparatus 100 may generally include a support system 200 and one or more fixtures 400 configured to hold a plurality of fiber optic connectors. A drive mechanism 300 may be coupled to the support system to move the fixtures 400 in one or more directions. Also provided is a polishing sub-assembly 500 including various components to polish the plurality of fiber optic connectors held by the fixtures 400. A control panel 700 for controlling the polishing apparatus 100 may also be provided.

A detailed description is provided below of the various components comprising the example polishing apparatus 100 and a method of using the polishing apparatus 100. The description below is provided by way of example only. Other configurations and methods of use are also possible with departing from the spirit of the invention.

I. The Support System

Referring again to FIGS. 3–6, the polishing apparatus 100 includes the example support system 200. The support system 200 generally includes a support structure 210 that is configured to support the components of the polishing apparatus 100, including the fixtures 400, the drive mechanism 300, the polishing sub-assemblies 500, and the control panel 700. Also included is a drive mechanism cover 215 covering the drive mechanism 300, as well as an electrical components housing 230 covering various electrical components used to control the polishing apparatus 100. A plurality of fixed supports 240 (e.g., adjustable feet) and wheels 245 are also provided to allow for the support and relocation of the polishing apparatus 100.

Figure 5:
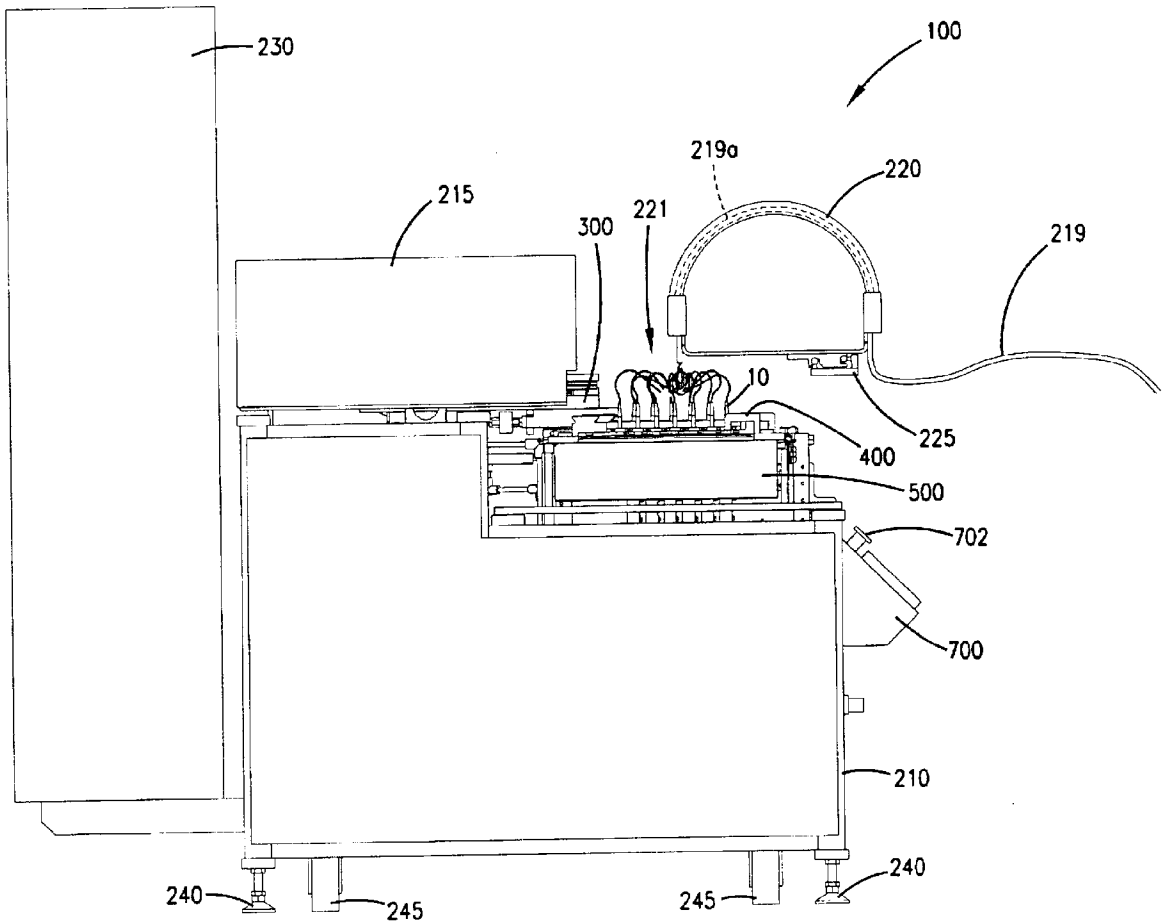
FIG. 5 is a side view of the example polishing apparatus of FIG. 3.
Figure 6:
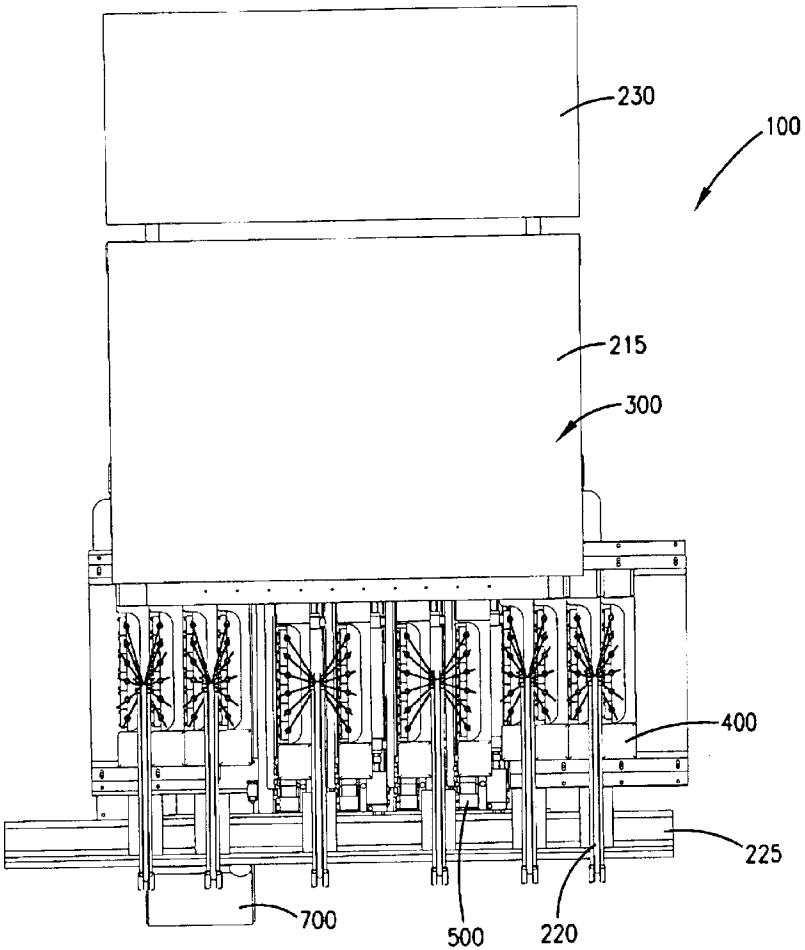
FIG. 6 is a top view of the example polishing apparatus of FIG. 3.

A plurality of cable supports 220 is also provided. The cable supports 220 generally function to hold an end segment of one or more fiber optic cables and allow the end segment to extend through the cable support 220 and over the fixtures 400. As shown in FIG. 5, this fiber optic cable 219 may include a plurality of smaller cables 221, each being terminated by a connector, such as the connector 10. For example, in the embodiment shown in FIG. 5, the larger cable is maintained on a separate support (not shown) positioned adjacent each cable support 220. An end segment 219*a* of the larger cable is extended through the cable support 220, and each of the connectors 10 of each of the smaller cables 221 contained therein are held by fixtures 400 positioned below each cable support 220.

In the example embodiment shown, the cable supports 220 are mounted to a railway 225 and are configured to slide along the railway 225 as the fixtures 400 are moved, as described in detail below. The railway 225 may be supported separately from the polishing apparatus 100, as is shown in the example embodiment. Alternatively, the railway 225 may be coupled to and supported by the polishing apparatus 100.

II. The Drive Mechanism

Referring now to FIGS. 7–11, the cover 215 has been removed to illustrate the drive mechanism 300 with greater clarity. The drive mechanism generally includes a Y-table 302 and an X-table 304 (see FIGS. 9 and 10). The Y-table 302 includes a Y-drive 310 and bearings 303 (see also FIGS. 27–42) that are mounted to a flat support 250 of the support system 200. The Y-table 302 is coupled to the Y-drive 310 and the bearings 303 so that the Y-drive 310 can move the Y-table 302 forward in a Y direction and backward in a Y' direction.

Figure 7:
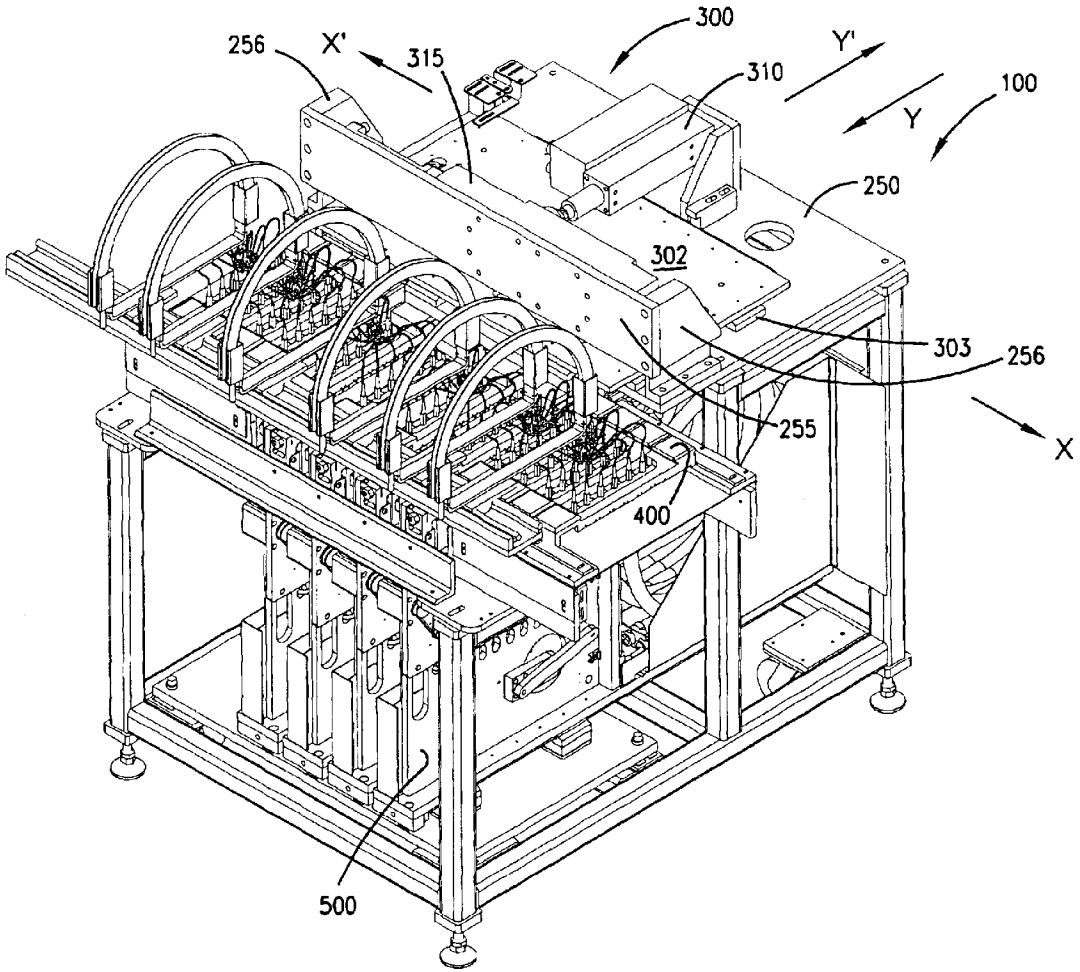
FIG. 7 is a perspective view of the polishing apparatus of FIG. 3 with various components including a cover of the drive mechanism omitted for clarity.
Figure 7A:
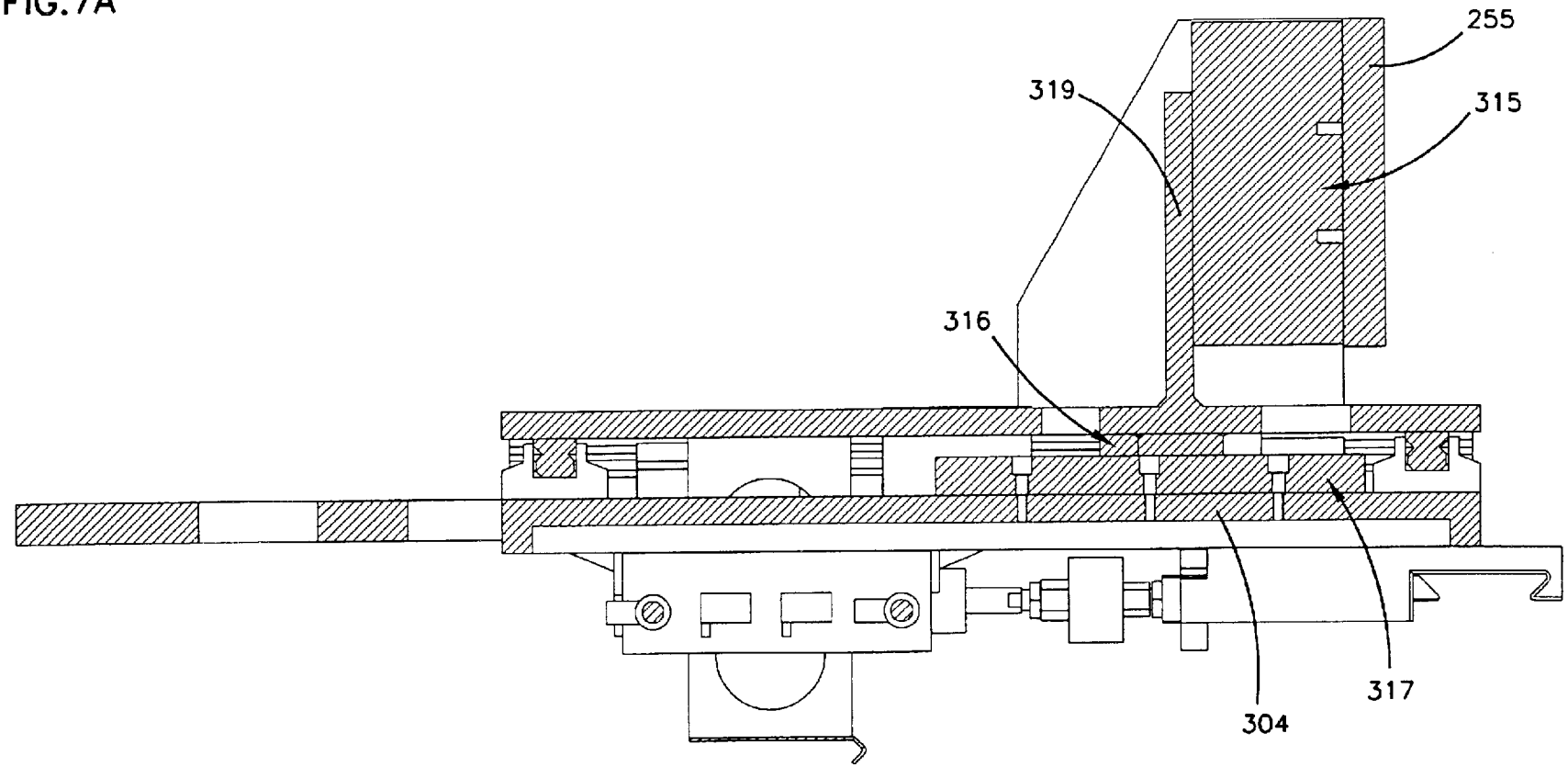
FIG. 7A is a cross-sectional view taken along section line CC—CC of FIG. 26 with various components including the fixtures omitted for clarity.
Figure 8:
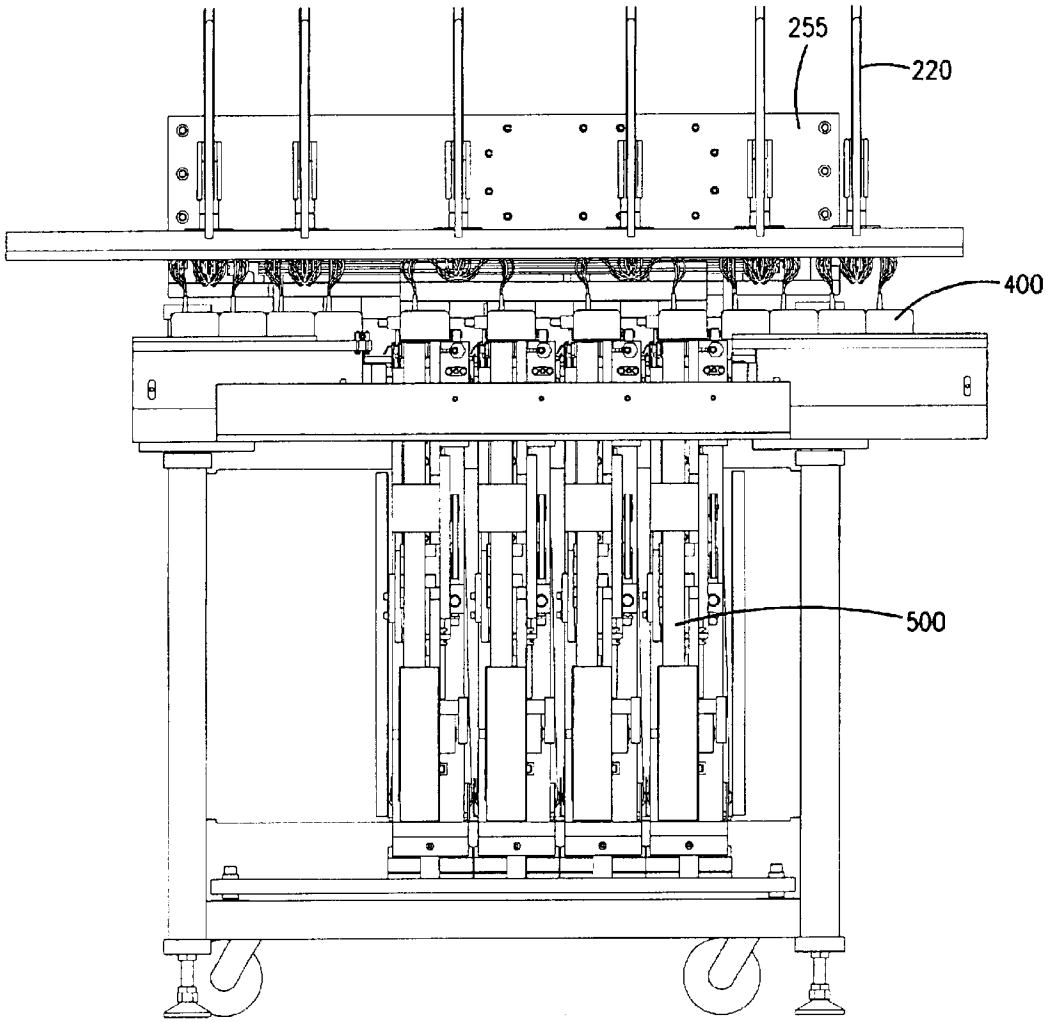
FIG. 8 is a front view of the polishing apparatus of FIG. 7.
Figure 9:
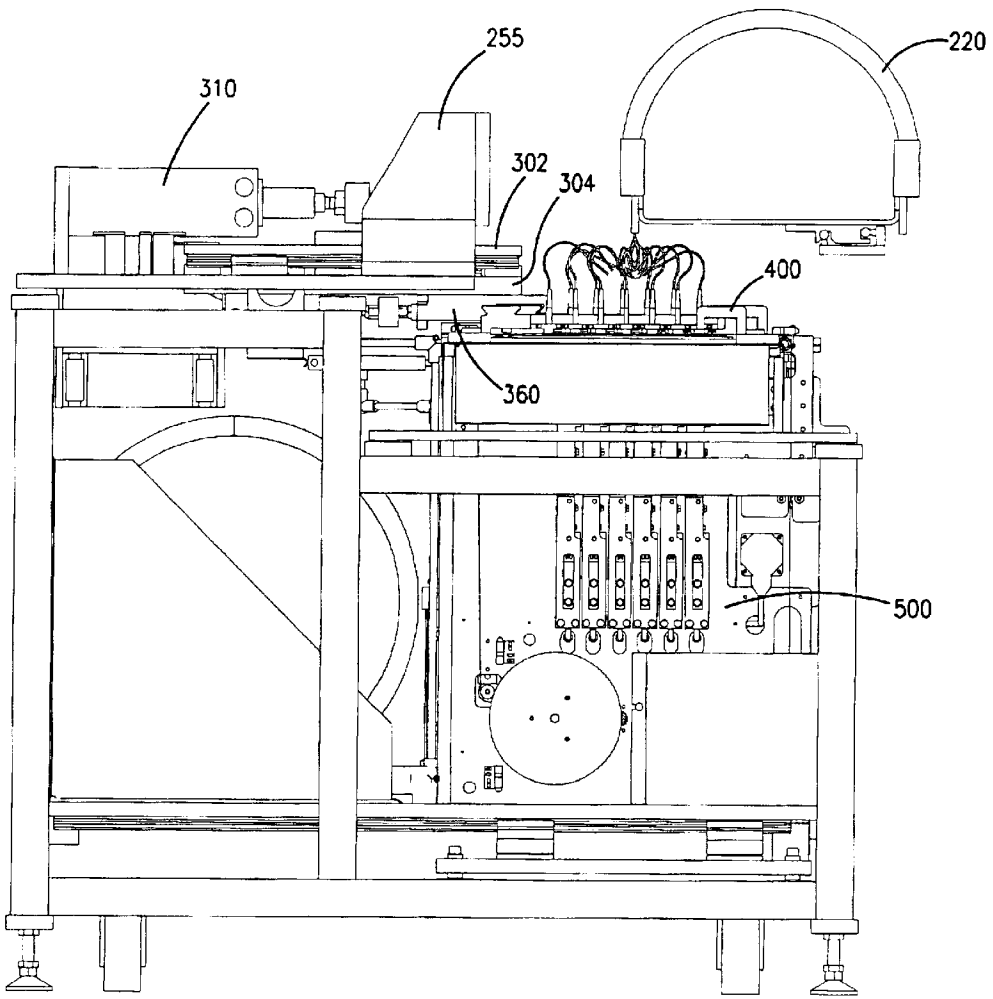
FIG. 9 is a first side view of the polishing apparatus of FIG. 7.
Figure 10:
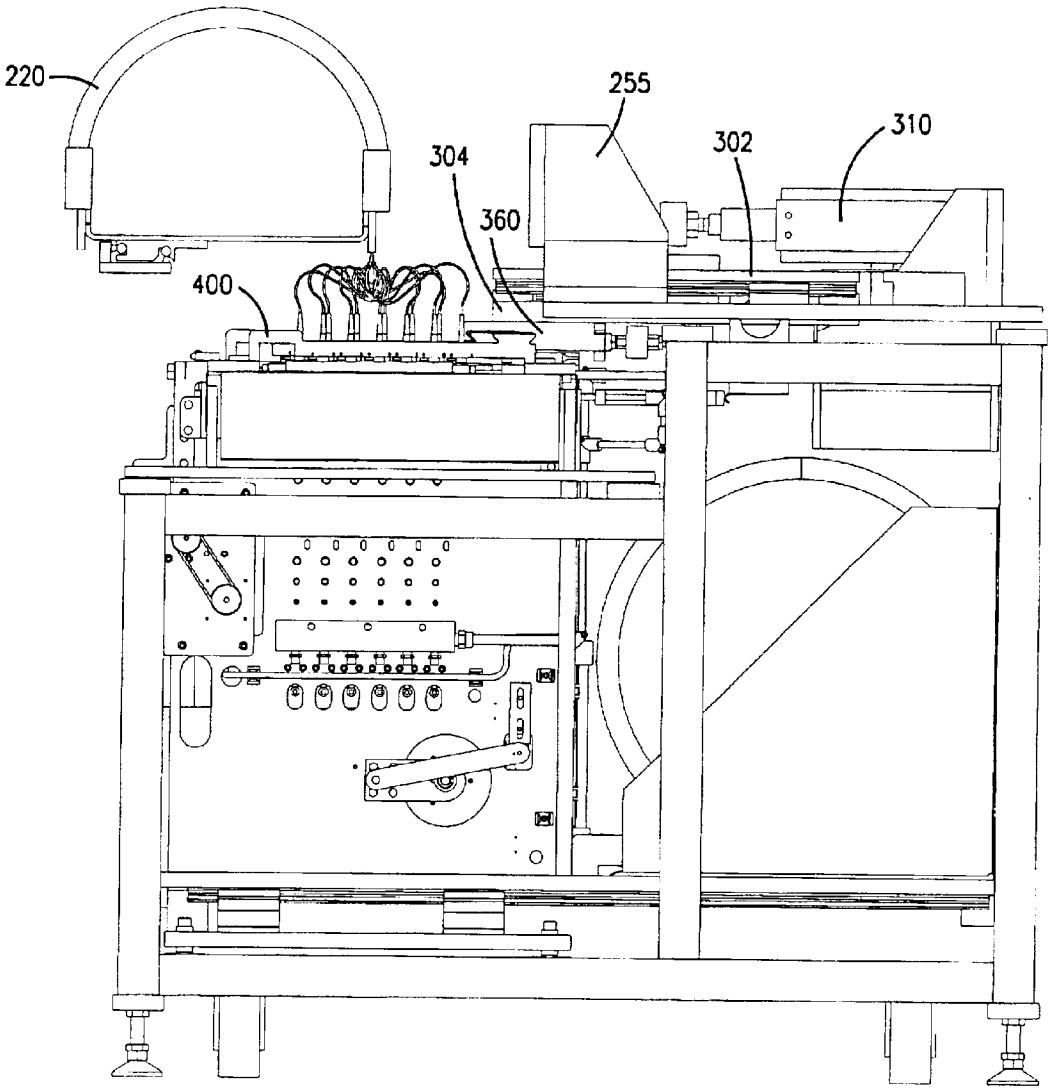
FIG. 10 is a second side view of the polishing apparatus of FIG. 7.
Figure 11:
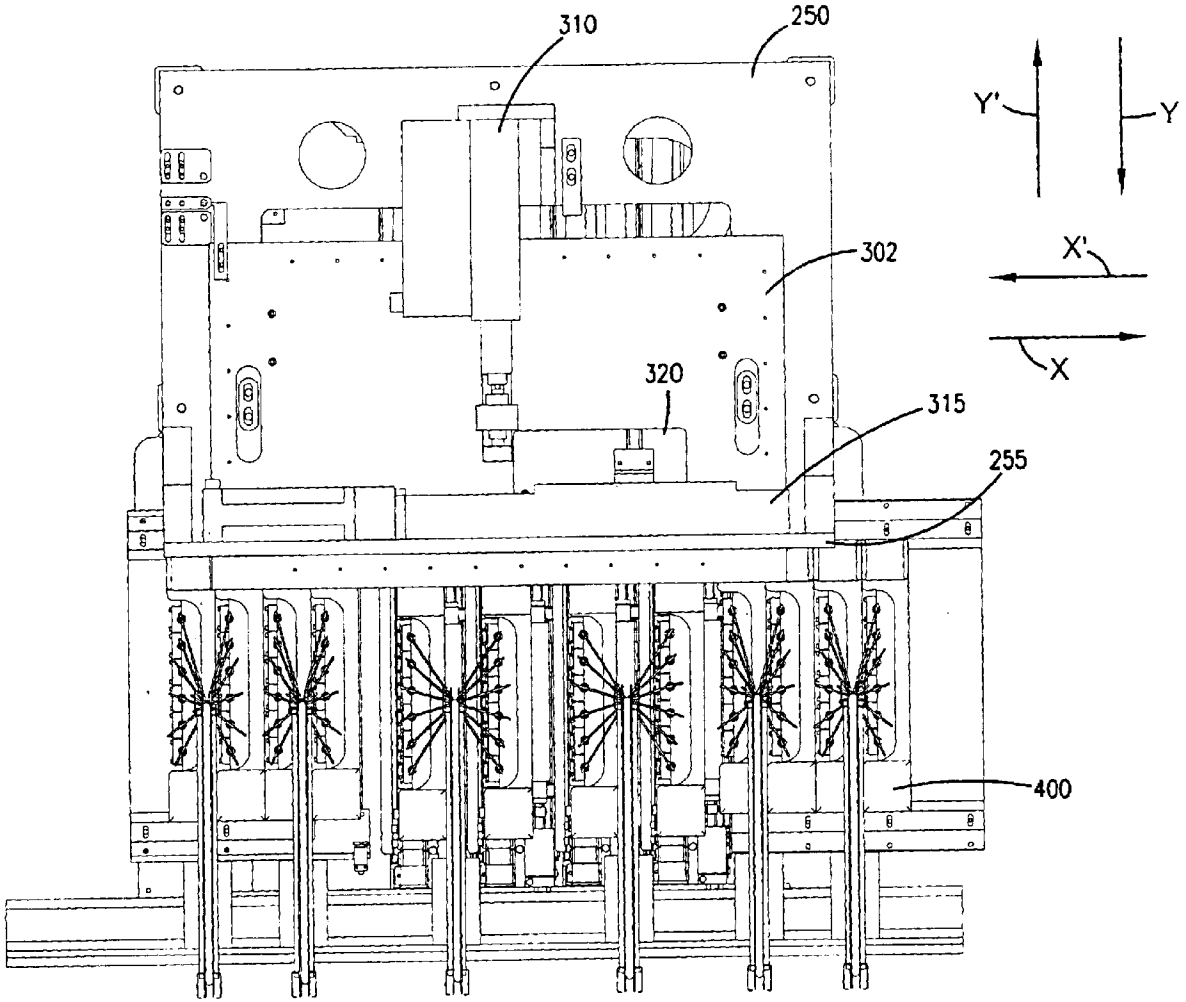
FIG. 11 is a top view of the polishing apparatus of FIG. 7.

The X-table 304 is coupled to a bottom of the Y-table 302 so that the X-table 304 also moves with the Y-table 302 in the Y and Y' directions. The X-table 304 is coupled to the Y-table using bearings 305 (see FIGS. 27–42) and includes an X-drive 315 mounted to a support 255 coupled by supports 256 to the support 250 and extending over the X and Y tables 302 and 304. An X-drive shaft 319 (see FIGS. 7, 7A, and 27) extends from the X-drive 315 through an aperture 320 (see FIG. 11) formed in the Y-table 302 and is coupled to a bearing 316 that rides on a rail 317 coupled to the X-table 304.

The X-drive 315 can, through the X-drive shaft 319, cause the X-table 304 to move in an X direction and opposite X' direction. When the Y-drive causes the table to move in the Y and Y' directions, the X-table 304 also moves in the Y and Y' directions because the bearing 316 rides along the rail 317, allowing the X-table 304 to move in the Y and Y' directions while the X-drive shaft 319 and the X-drive 315 remains stationary or moves in the X and X' directions.

The X-table 304 is, in turn, coupled to each of the plurality of fixtures 400. In this configuration, the drive mechanism 300 can move the fixtures 400 in both the X, X', Y, and Y' directions or a combination thereof.

Both the Y-drive 310 and the X-drive 315 are coupled directly to the support system 200 and are mounted in a fixed position (i.e. the Y-drive is fixedly mounted to the support 250 and the X-drive is fixedly connected to the support 255). This may be advantageous for several reasons, including: (1) any supporting components, such as electrical cords (if the Y and X-drivers are electrically driven, as is the case in the example embodiment shown) or air housing (if the Y and X-drives are pneumatically driven) are held in a stationary position, thereby eliminating any flexure which may cause stress and subsequent failure; and (2) fixedly-coupling the drives may reduce or eliminate possible fluctuations in movement in the Y, Y', X, and X' directions due to vibration and/or other disturbances transmitted to the Y and X-drives.

III. The Fixtures

Referring now to FIGS. 12–15, each fixture 400 includes a plurality of connector locations 410 sized to each receive a body of a fiber optic connector (e.g., connector body 18 of the fiber optic connector 10 shown in FIG. 1) and allow an end face of each fiber optic connector (e.g., end face 13) to extend through each connector location 410. In the illustrated embodiment, each fixture 400 includes six connector locations 410 so that each fixture 400 can hold six connectors. In alternative embodiments, the fixture can be configured with more or fewer connector locations to hold more or fewer connectors, such as, for example, three connector locations to hold three connectors.

Figure 14:
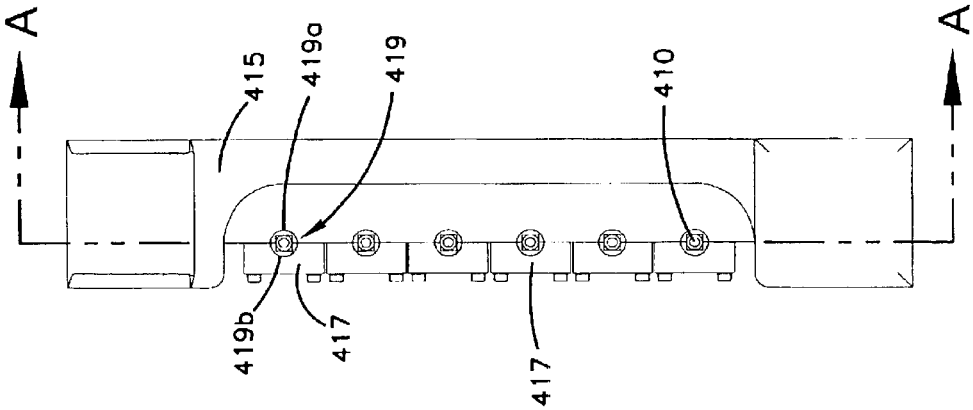
FIG. 14 is a top view of the fixture of FIG. 12.
Figure 15:
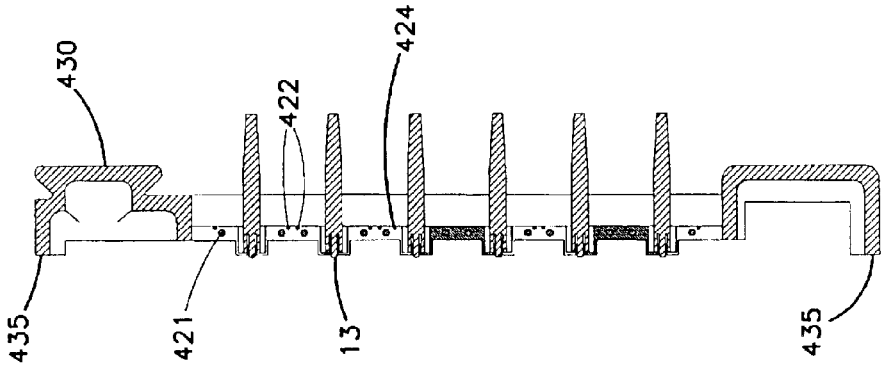
FIG. 15 is a cross-sectional view taken along section line A—A of FIG. 14.
Figure 13:
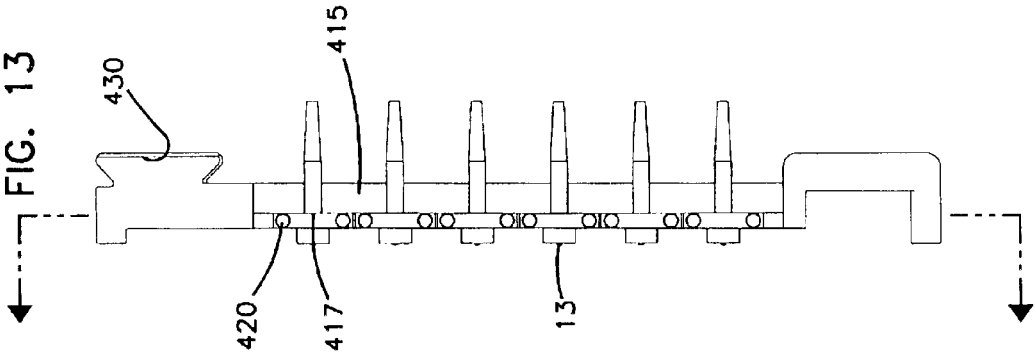
FIG. 13 is a side view of the fixture of FIG. 12.
Figure 12:
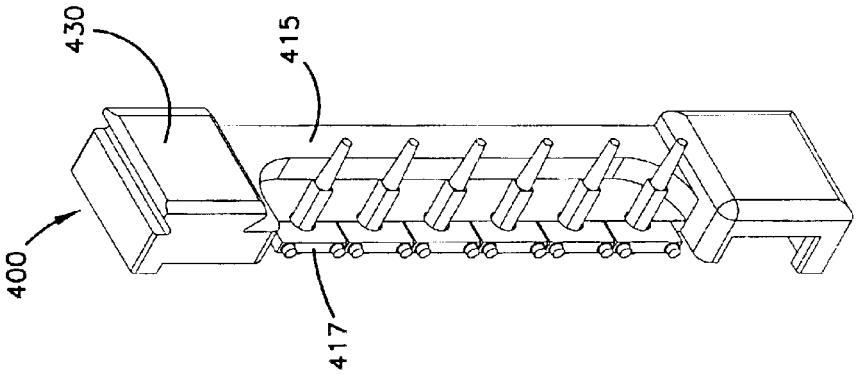
FIG. 12 is a perspective plan view of an example embodiment of a fixture shown in isolation.

Each fixture 400 includes a main body 415. A plurality of moveable connecting slates 417 is coupled to the main body 415. The slates 417 cooperate with the main body 415 to define a plurality of nests 419 for receiving connectors 10. In the embodiment of FIG. 14, each nest 419 includes a half-nest 419*a* defined by the main body 415 and a half-nest 419*b* defined by a corresponding slate 417.

Each connecting slate 417 is coupled to the main body 415 using two fasteners (e.g., screws 420) threaded within openings 421 defined by the main body 415. Each screw 420 includes one or more "belville" washers to provide clamping force and compliance to allow the clamps to open. In addition, small metallic balls (not shown) are positioned in apertures 422 formed in a surface 424 of the main body 415 so that, when the connecting slates 417 are coupled to the main body 415, the balls are sandwiched between the main body 415 and the connecting slates 417. In this configuration, the screws 420 and the balls allow the connecting slates 417 to pivot with respect to the main body 415 and thereby increase the opening of the connector locations 410 to facilitate the introduction and removal of each fiber optic connector into and out of each fixture 400.

Alternative structures can also be used to hold each connector body within the fixture. For example, instead of clamping the ferrule of a connector, as describe above, another portion of the connector can be held to maintain the connector at a known orientation within the fixture. For example, the fixtures can be configured to clamp on the boot of each connector, and each fixture can include a close-tolerance hole through which the end face of each ferrule extends to be polished. This may be advantageous in that only a portion of the ferrule, including the end face, extends through the fixture to the polishing sub-assembly, so that the remainder of the connector body is isolated from any debris generated during polishing. In another embodiment, both an upper portion of a connector, such as the boot, as well as the ferrule can be clamped by the fixture to hold the connector in place during polishing. Other configurations are also possible.

Figure 19:
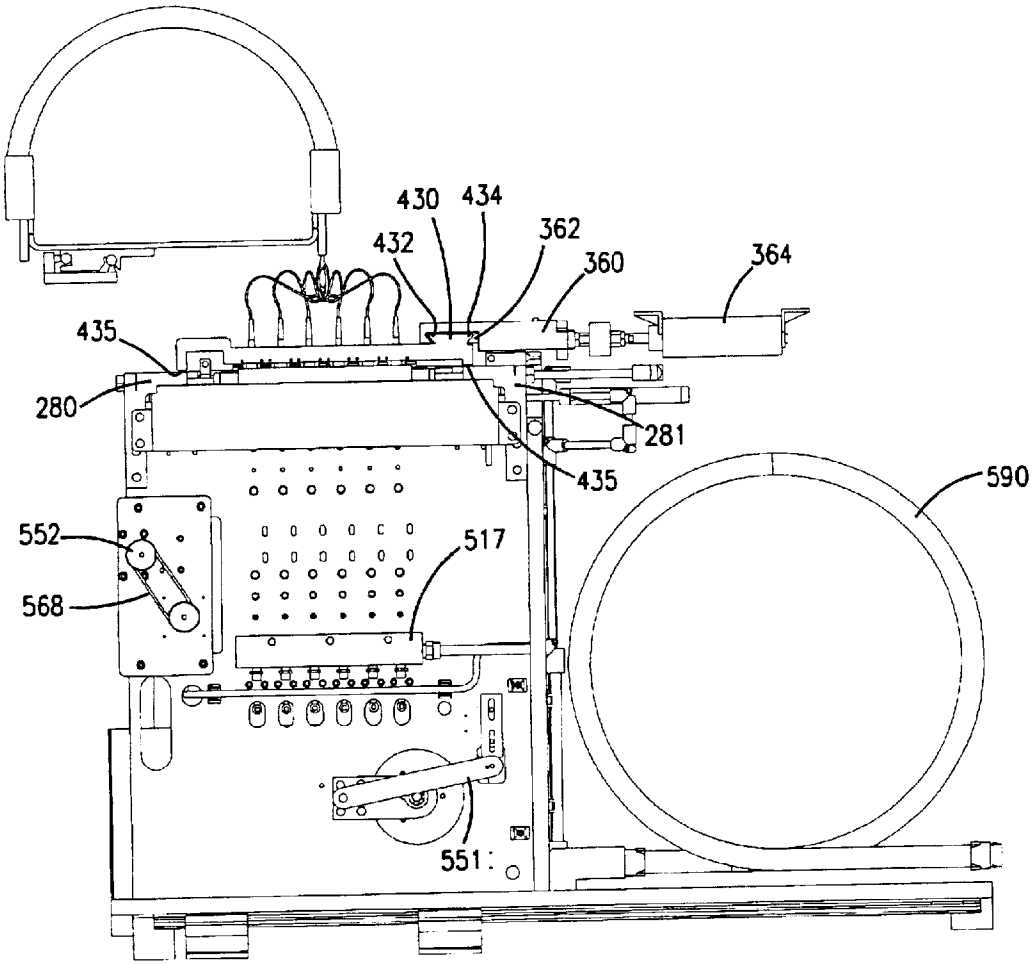
FIG. 19 is a first side view of the polishing sub-assembly of FIG. 16.
Figure 20:
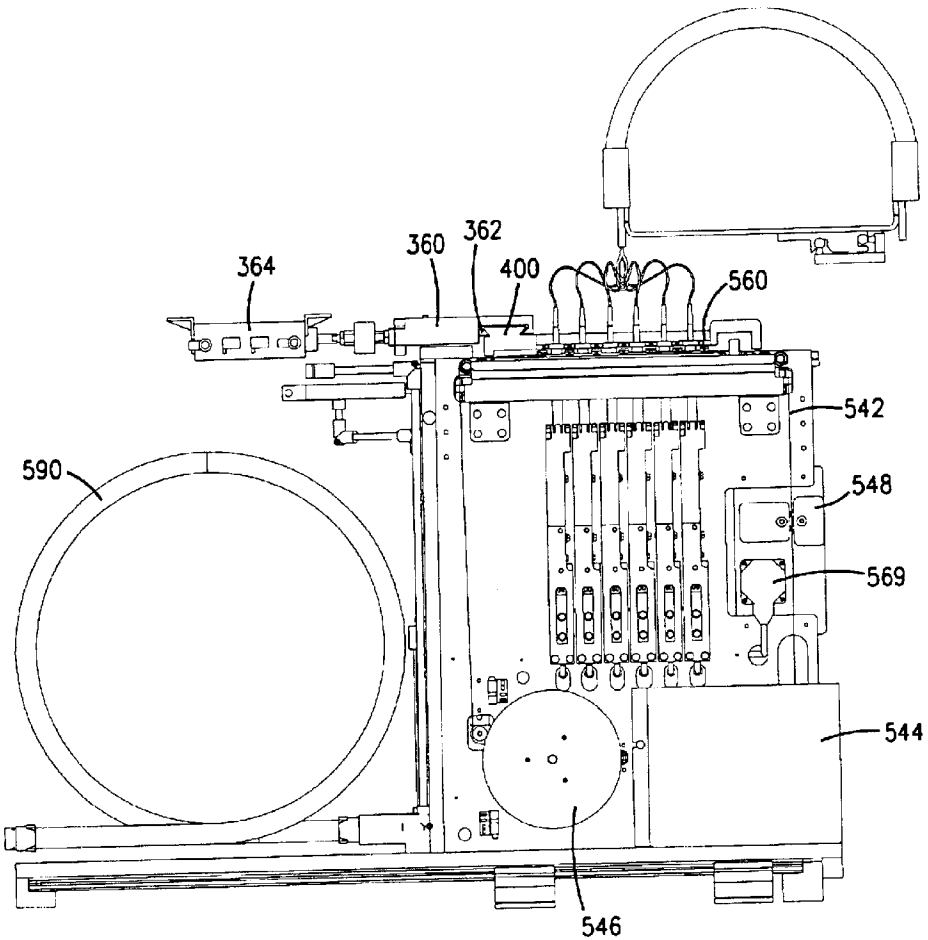
FIG. 20 is a second side view of the polishing sub-assembly of FIG. 16.
Figure 21:
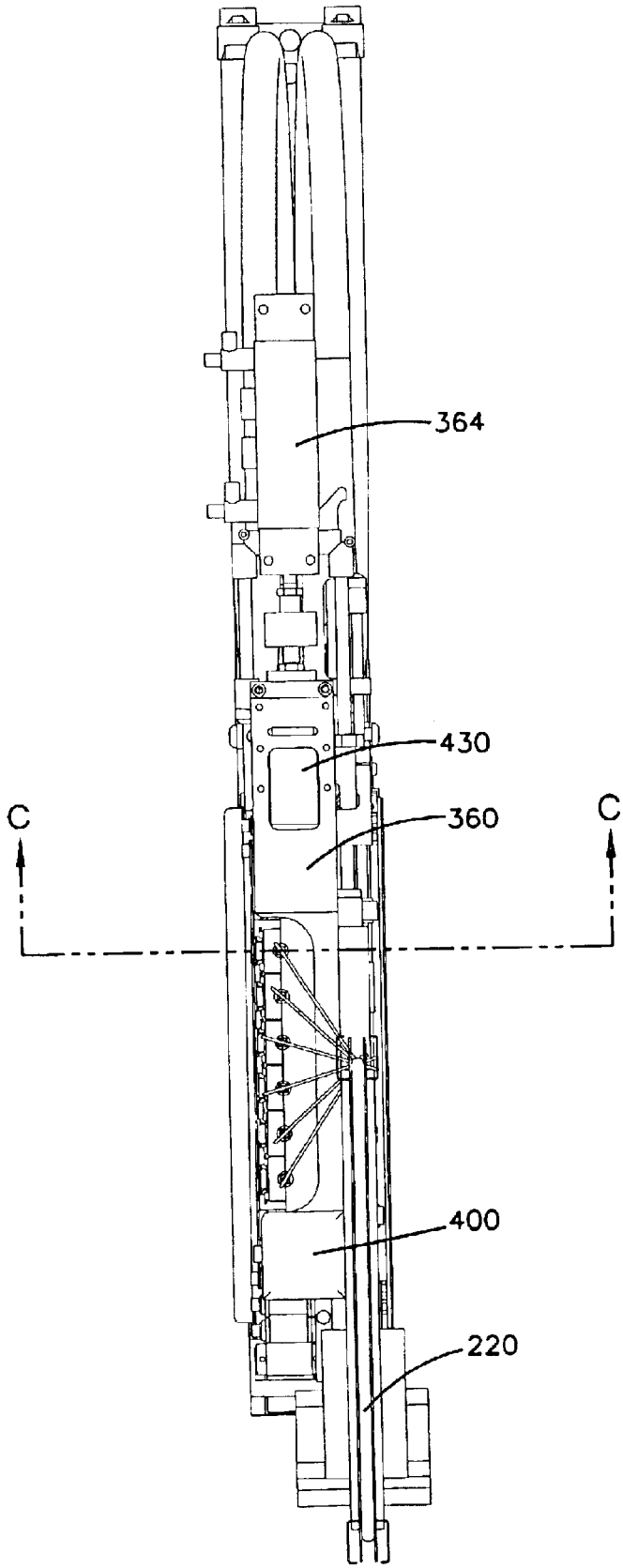
FIG. 21 is a top view of the polishing sub-assembly of FIG. 16.
Figure 22:
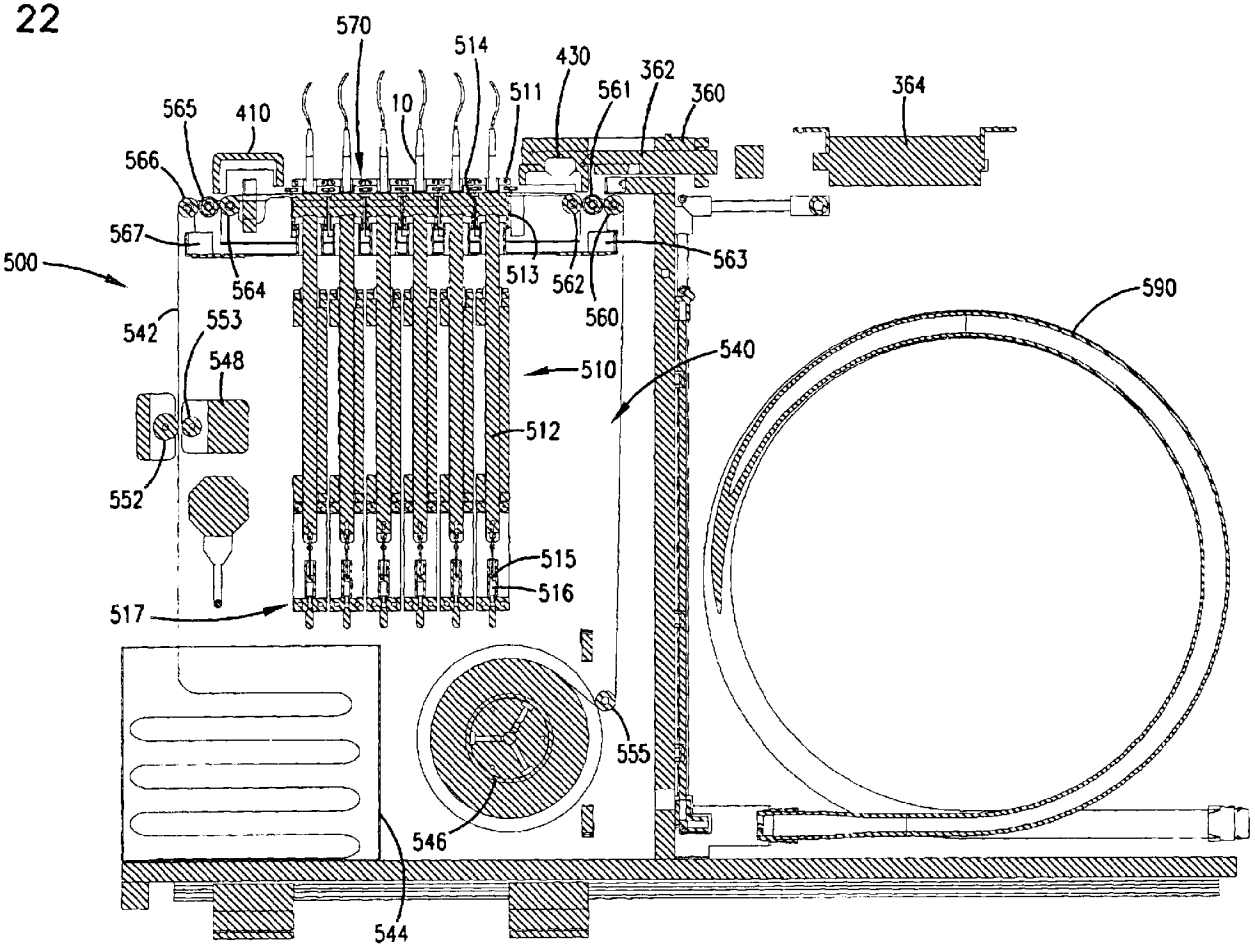
FIG. 22 is a cross-sectional view taken along section line B—B of FIG. 18 of the polishing sub-assembly.

Referring now to FIGS. 19, 20, and 22, each fixture 400 also includes a gripping feature 430 positioned on one end of the fixture 400. The gripping feature 430 is shaped to allow a gripping arm 360, which is mounted to the X-table 304, to grab and manipulate each fixture 400. The gripping feature 430 includes first and second opposing projections 432 and 434 that fit into a complementary geometry of the gripping arm 360. The gripper arm 360 further includes an air cylinder 364 coupled to the gripper arm 360 which causes a piston 362 to project against the projection 434 on the fixture 400, thereby further holding the fixture 400 in the gripper arm 360 and level with the polishing sub-assemblies described below.

In addition, the fixture 400 includes resting surfaces 435 used to support the fixture 400 when it is in a nested position, as described further below.

The fixture 400 is further designed to be used to hold the connectors 10 throughout other processes besides polishing, such as, for example, epoxy dispense, curing, and cleaving.

IV. The Polishing Sub-Assemblies

Referring now to FIGS. 16–24, an example embodiment of one polishing sub-assembly 500 is shown. The polishing sub-assembly 500 may generally include a pad system 510 (shown in FIG. 22), a polishing film system 540 (shown in FIG. 17), a fluid injection system 570 (shown in FIG. 23), and an optional rinsing system 580 (shown in FIG. 16). A circular tube guide 590 may also be provided to guide various wires and supply tubes, such as, for example, electrical wires, pressurized air tubes, and fluid tubes, into and out of the polishing sub-assembly 500.

Although only a single polishing sub-assembly 500 is described in detail below, a plurality of polishing sub-assemblies 500 may be included with the polishing apparatus 100. In the illustrated embodiment, four polishing sub-assemblies are provided so that four fixtures including connectors contained therein can be processed at one time. In alternative embodiments, more or fewer sub-assemblies can be provided to handle more or fewer fixtures at one time, such as, for example, between one and ten polishing sub-assemblies.

Detailed descriptions of examples systems comprising the polishing sub-assembly 500 are provided below. As previously stated, other configurations for the sub-assembly 500 are also possible.

(a) The Pad System

The pad system 510 is shown, for example, in FIGS. 22–25. The pad system 510 generally includes a plurality of pads 511 and corresponding pad shafts 512, preferably one pad 511 and one pad shaft 512 for each connector location 410 of each fixture 400. Each pad 511 is coupled to a first end of the pad shaft 512. A second end of the pad shaft 512 is coupled to a piston 515 positioned in a bore 516. As air is applied to the piston 515 in the shaft 516, the shaft 512 and attached pad 511 are moved in a vertical direction upward towards a connector held in the fixture 400 above the pad 511 (see FIG. 31A). Guides 513 and 514 assure that the pad is held in a known orientation (e.g., vertical) as it moves vertically up towards the connectors.

As described below, air can be applied in the bore 516 until the pad 511 moves vertically upwards to compress a polishing film against the end face 13 of each connector 10 with a desired force (e.g., ¾ lb. for polishing FC or SC connectors according to the example embodiment shown). As the air pressure in the bore 516 is reduced, the shaft 512 and attached pad 511 may move in an opposite direction back towards a resting position, thereby disengaging the pads 511 from the connectors 10 (see FIG. 31B).

Figure 16:
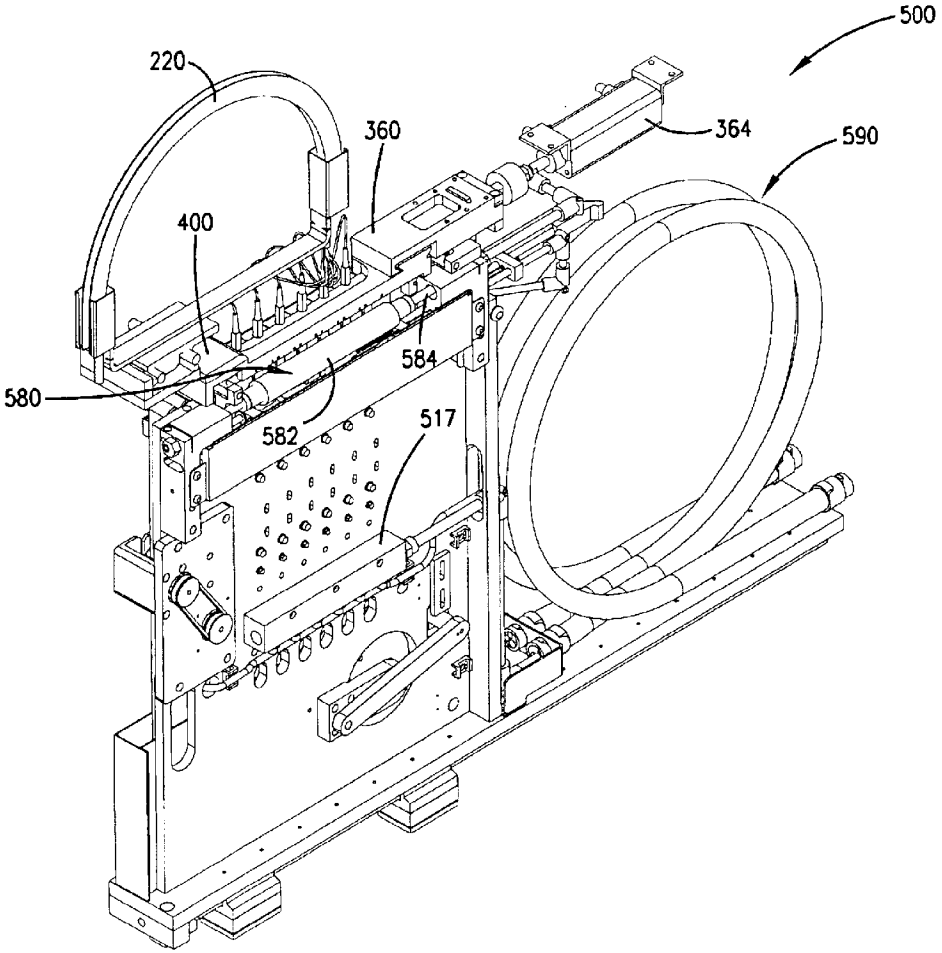
FIG. 16 is a first perspective plan view of an example embodiment of a polishing sub-assembly shown in isolation.
Figure 17:
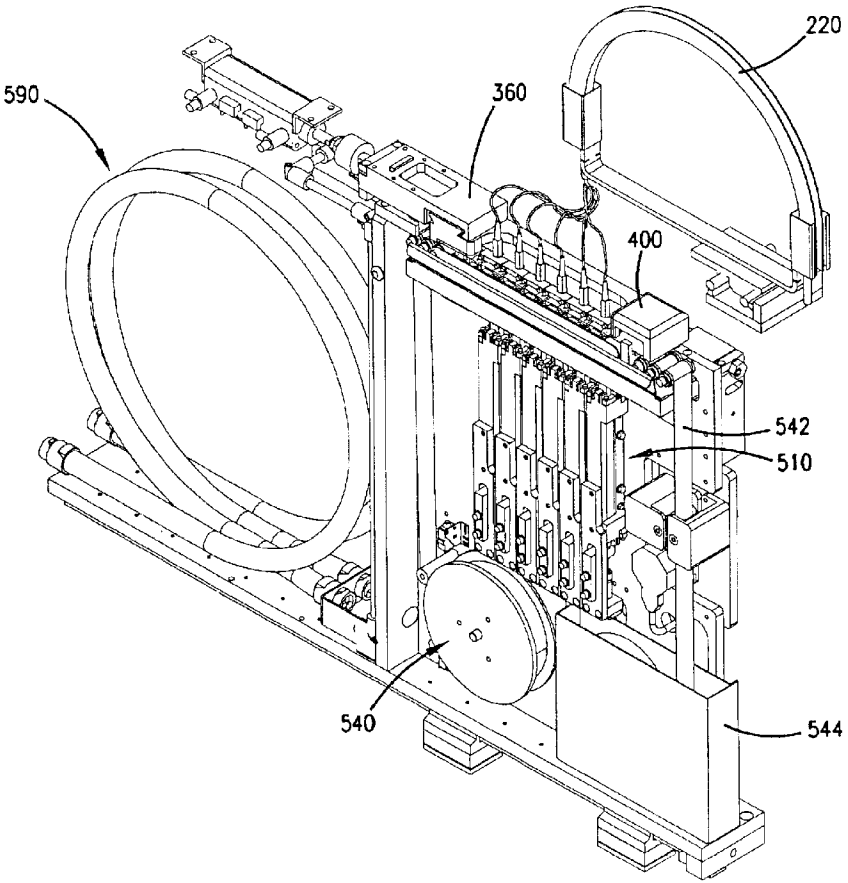
FIG. 17 is a second perspective view of the polishing sub-assembly of FIG. 16.
Figure 18:
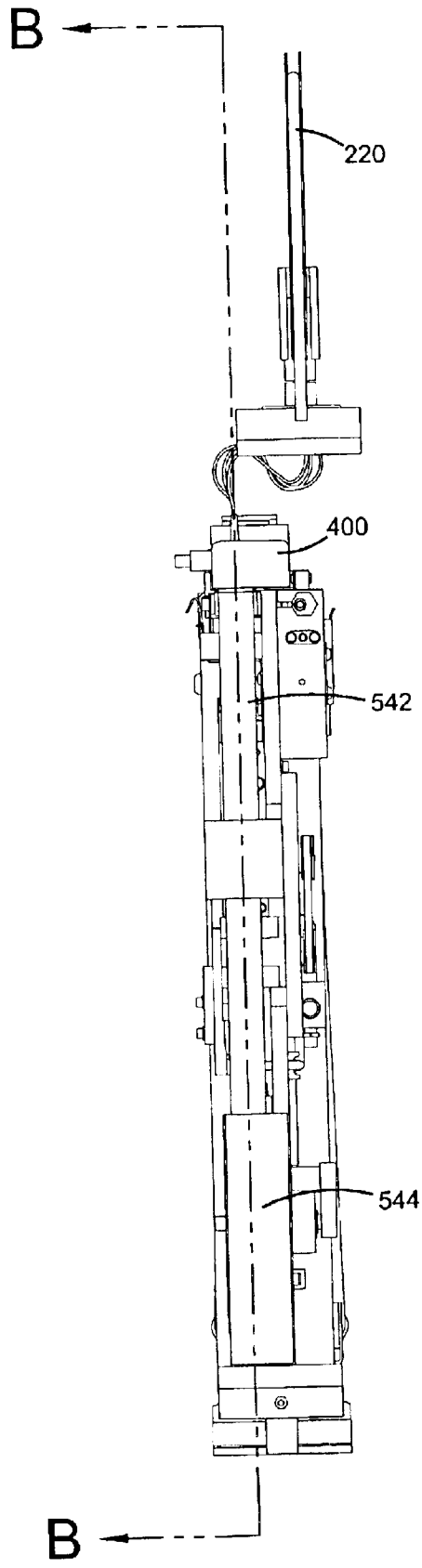
FIG. 18 is a front view of the polishing sub-assembly of FIG. 16.

Each bore 516 on the polishing sub-assembly 500 is fed air from a common air manifold 517 (see FIG. 16). Therefore, each bore 516 preferably receives the same air pressure provided by the air manifold. In this manner, each pad 511 may engage each end face 13 at an equal force regardless of the position of each end face 13 with respect to each pad 511. In an alternative embodiment, pressure provided to each pad can be independently controlled, if desired.

In the illustrated embodiment, the pad system 510 utilizes a system of linear bearings so that each pad shaft and pad can be moved upwardly and downwardly with respect to the remainder of the polishing sub-assembly 500. Alternatively, other systems allowing the necessary movement of the pad shaft and pad can be used, such as, for example, a parallel linkage mechanism. This alternate type of mechanism may be advantageous to reduce the friction associated with the movement of the pad shaft.

Optionally, a system (not shown) can be provided to regulate the rate of accent of the pads towards the ferrules of the connectors. For example, each pad 511 or pad shaft 512 can be coupled to a cam that rotates as the pad moves upward to contact a ferrule. The cam can be regulated to control the rate of accession. After the pad contacts the ferrule and polishing begins, the pad and/or pad shaft is released from the cam. This may be advantageous so that the pads contact the ferrules with at a given rate.

In the example embodiment shown, the pads 511 are made of Neoprene. Other materials may also be used, such as Buna N, viton, urethane, silicone, etc. or any other material that can withstand deionized water or other fluids used and can be manufactured with the desired durometer (i.e., stiffness) for a given polishing application.

(b) The Polishing Film System

The polishing film system 540, as shown in FIGS. 19–22, generally includes polishing film 542, a spool 546, a used film collection bin 544, a pincher roller 548, and a plurality of rollers. New polishing film is provided on the spool 546. The polishing film 542 is directed around a tension roller 555, with tension being maintained by tension shaft 551 (see FIG. 19), and through a series of rollers 560, 561, and 562. Preferably, the polishing film 542 travels over roller 560, under roller 561, and over roller 562. This configuration is preferable so that any fluid maintained on the polishing film 542 (as described below) falls into a drip tray 563 rather than running down the polishing film 542 and onto the new polishing film maintained on the spool 546 or into the used film collection bin 544. In one example embodiment, 3M Imperial Diamond Lapping Film with a one micron grit manufactured by Minnesota Mining and Manufacturing of St. Paul, Minn. was used as the polishing film 542.

The polishing film 542 then travels over the plurality of pads 551 and then over and under a second series of rollers 564, 565, and 566, with a trap 567 functioning similarly to the drip tray 563. The polishing film 542 then runs through the pincher roller 548 that engages the polishing film 542 with opposing rollers 552 and 553 driven by motor 569 and belt 568 used to index the polishing film, as described below. This indexing can be configurable, as desired, to control the amount of polishing film reuse. Finally, the used polishing film falls into the used film collection bin 544. Alternatively, instead of the film collection bin 544, a second spool can also be used to maintain the used polishing film prior to discarding it.

Polishing the end face 13 of a connector 10 can be accomplished by compressing the end face 13 against the polishing film 542, such as with the pad system 510. With the connector 10 compressed against the polishing film 542, the connector 10 can be moved in a sequence of patterns over the polishing film 542, thereby polishing the end face 13. In addition, as described below, a plurality of polishing sub-assemblies 500 may be provided, with each polishing sub-assembly having a difference coarseness of polishing film 542. For example, coarse, medium, and fine polishing grades of polishing film can be used. In this configuration, the end face 13 can be sequentially polished with the different grades of polishing film to a desired polished state.

(c) The Fluid Injection System

Figure 23:
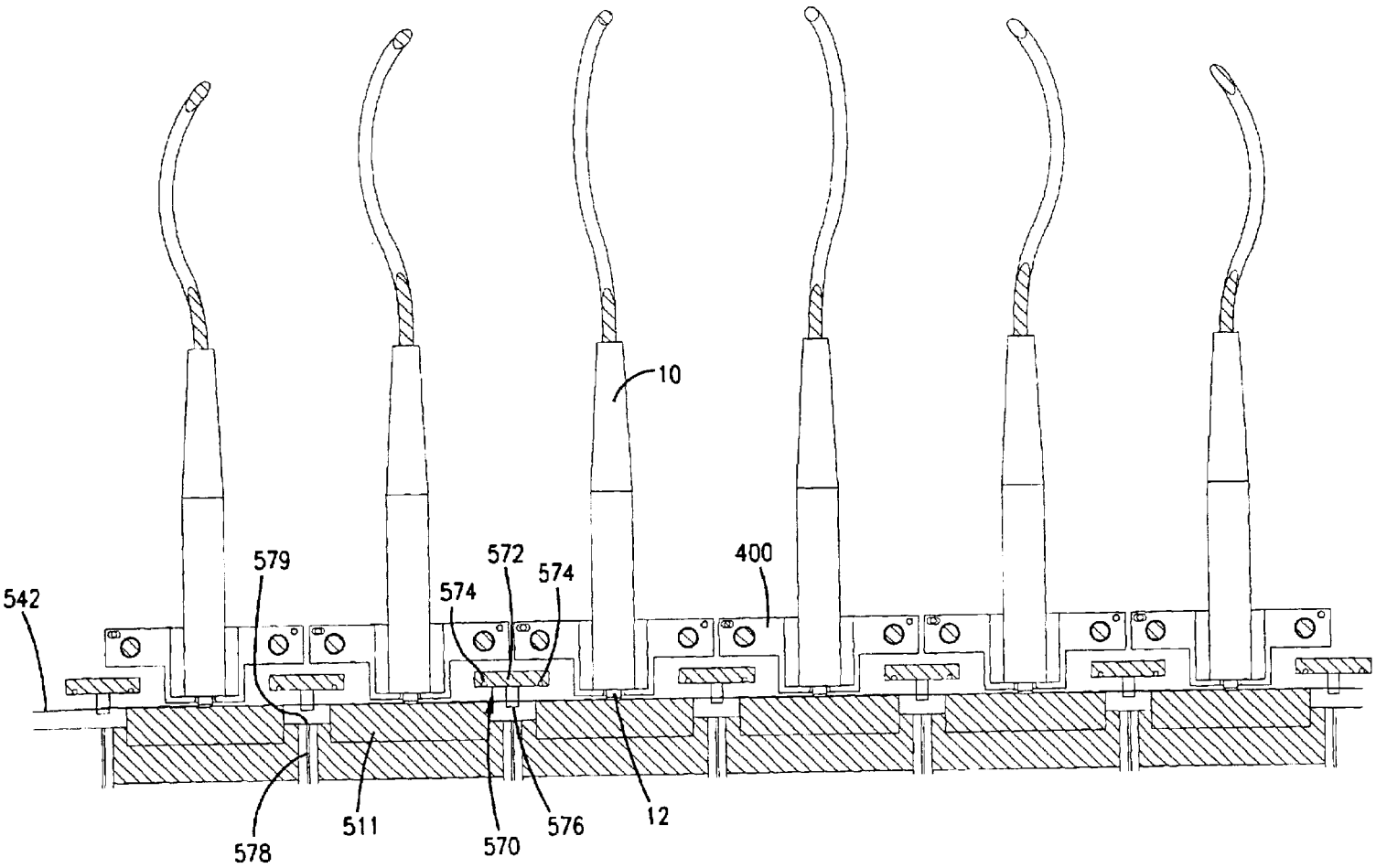
FIG. 23 is an enlarged view of a portion of the sub-assembly shown in FIG. 22.
Figure 24:
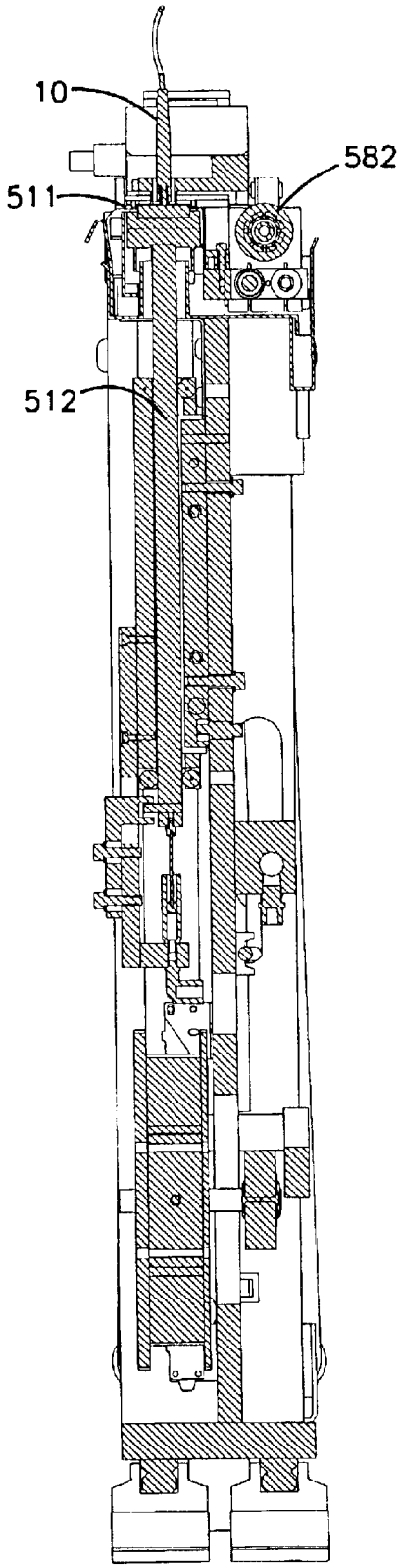
FIG. 24 is a cross-sectional view taken along section line C—C of FIG. 21 of the polishing sub-assembly.

Referring now to FIGS. 22–25, the fluid injection system 570 is shown. As shown in FIG. 23, the fluid injection system 570 includes a plurality of jet bars 572 positioned to extend parallel to a longitudinal direction of the fixtures 400 between adjacent connectors and over the polishing film 542. Each jet bar 572 includes a series of jets 574 formed in the bar 572. The jets 574 deliver a series of streams of de-ionized water onto the polishing film 542. In the illustrated embodiment, each jet bar 572 is configured to move as each fixture is moved to polish the connectors contained therein. In alternative embodiments, each jet bar 572 can be fixed in place.

The de-ionized water functions to facilitate the movement of the end faces 13 of each connector 10 over the polishing film 542, as well as to clean and remove debris from the polishing film 542 and the end faces 13 of the connectors 10. In alternative embodiments, other types of fluid such as a slurry of alcohol and water mixes may be used in place of the de-ionized water.

In the example embodiment illustrated, the water is injected throughout the polishing cycle. However, fluid injection system 570 may be fully programmable to allow the water to be turned on and off during each cycle as desired.

As shown particularly in FIGS. 23 and 25, each jet bar 572 further includes alignment pins 576 positioned on opposite sides and extending below the level of the polishing film 542. The alignment pins 576 function to hold the polishing film 542 onto each pad 511 as polishing occurs.

As shown in FIG. 23, the fluid injection system 570 further includes a series of steel plates 578 positioned between each pad 511. Each plate 578 includes a contact surface 579 of limited surface area. When a polishing cycle is complete and the pads system 510 with pads 511 is allowed to move vertically downward to a rest position (see FIG. 31B), the contact surface 579 of each plate 578 extends above each pad 511 and makes contact and supports the polishing film 542. The small contact area between the plates 578 and the polishing film 542 can be advantageous in that if the film 542 is left in contact with the plates 578 for an extended period of time (e.g., when the polishing apparatus is not used for a period of time), there is little surface area of each plate 578 on which the polishing film 542 can adhere.

(d) The Rinsing System

Figure 25:
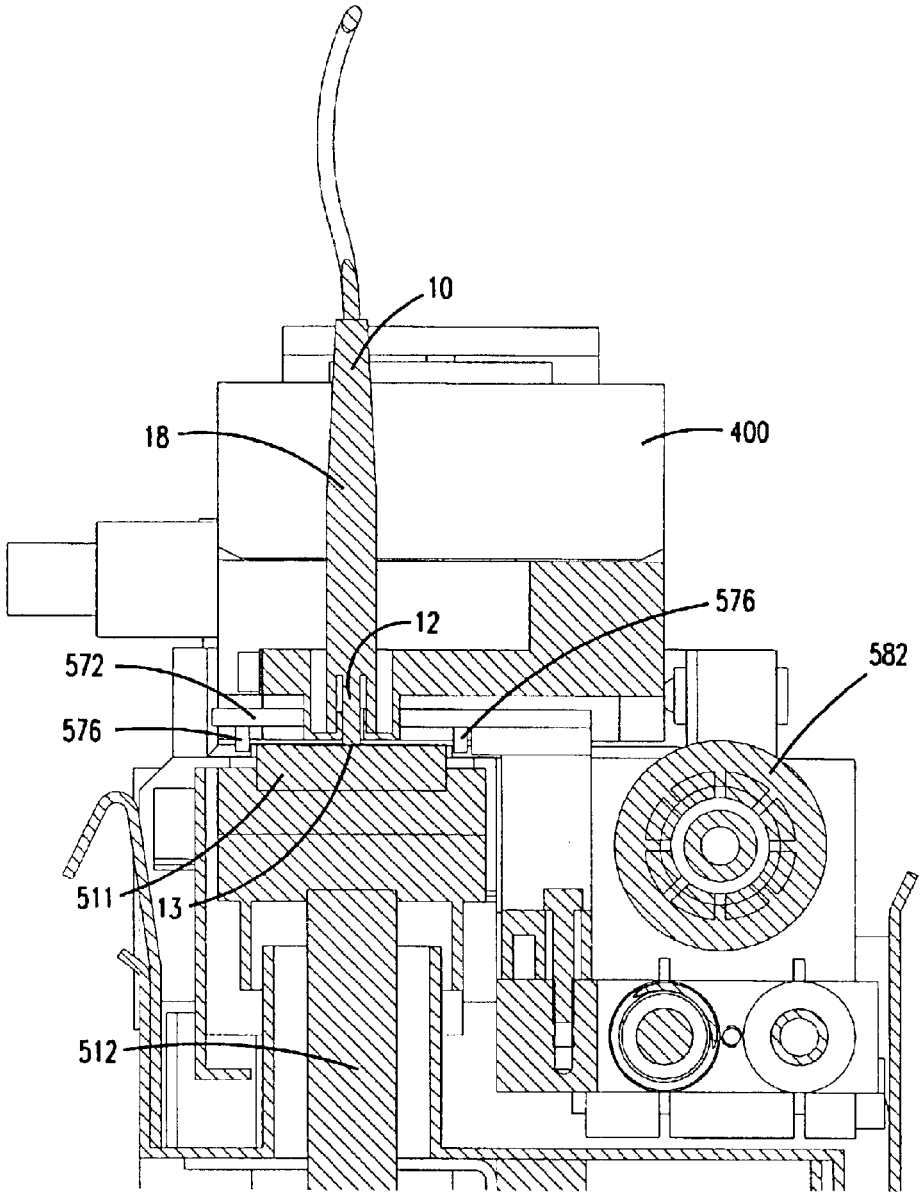
FIG. 25 is an enlarged view of a portion of the polishing sub-assembly shown in FIG. 24.

Referring now to FIGS. 16 and 25, in addition to the fluid injection system 570, the optional rinsing system 580 may also be provided on the polishing sub-assembly 500, if desired. The rinsing system 580 generally includes a roller 582 and a fluid supply 584 (see FIG. 16), in the example embodiment de-ionized water. The roller 582 may be made of any compliant material that becomes saturated with water, such as, for example, a foam material.

The fluid supply 584 runs through the roller 582 and small holes in the supply 584 positioned within the roller 582 allow the water to escape outwardly into the roller 582, thereby saturating the roller 582 with de-ionized water. In this manner, the roller 582 may be maintained in a saturated state. In addition, the roller 582 may be mounted so that the roller 582 rotates about the supply 584.

The roller 582 is position adjacent the pads 511 and fixtures 400 so that, as described below, when a fixture 400 is moved from one polishing sub-assembly to another, the end faces 13 of the connectors 10 maintained in each fixture 400 are caused to pass over and rub against the saturated roller 582, thereby causing the rollers 582 to spin and any debris on the end faces 13 of the connectors to be removed. In an alternative embodiment, each fixture 400 may be passed back and forth over the roller 582 multiple times to more thoroughly clean the end faces 13. In this manner, the end faces 13 can be maintained in a clean state.

In alternative embodiments, other configurations besides a roller may also be used, such as a stationary rinsing pad.

V. The Control Panel

The control panel 700, as shown generally in FIGS. 3–6, functions to control the operation of the polishing apparatus 100, as described below. In addition to starting and stopping the apparatus 100, the control panel 700 may also be used to change polishing times, speeds, patterns, and other configurable parameters. In addition, the control panel 700 may include a computer-driven graphical user interface (GUI) to allow for ease of use. The GUI may include preset operational menu to allow a user to input different cable fiber types or product specifications to access pre-programmed polishing cycles. An emergency stop button 702 (see FIG. 5) may also be included to stop the apparatus 100, if needed.

VI. Methods of Use

Figure 26:
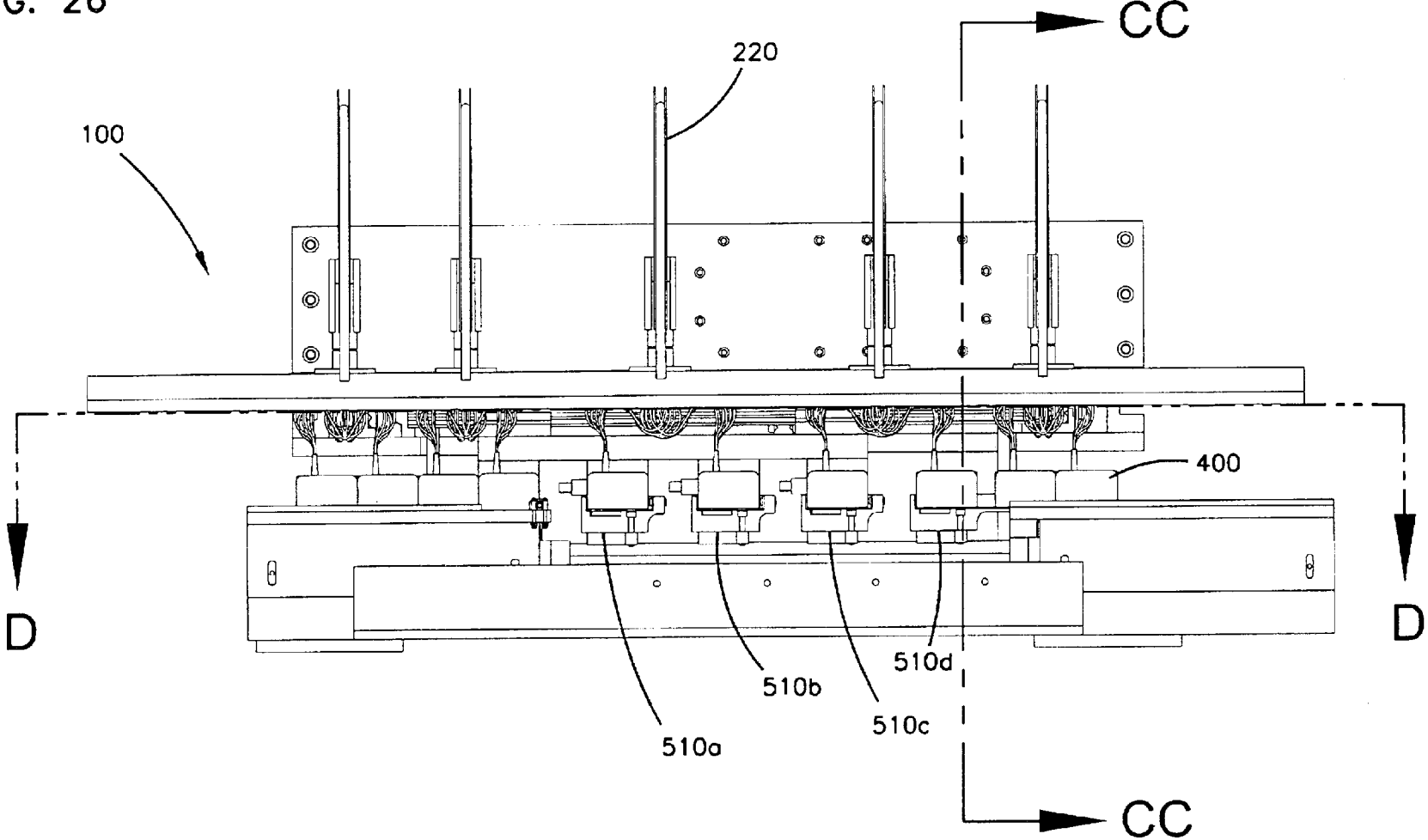
FIG. 26 is a front view of a portion of the example embodiment of the polishing apparatus with the fixtures in a nested position.

The polishing apparatus 100 may be used according to the method described below and illustrated in the cross-sectional views of FIGS. 27–42 taken along line D—D of FIG. 26. Throughout the steps provided below, movement of the Y-table 302 and the X-table 304 will be described and shown.

Reference throughout the method illustrated in FIGS. 27–42 will be made generically to various like components using a generic reference number, while reference to a specific components will be made using a reference number qualified with a letter. For example, generic reference to all fixtures illustrated in FIGS. 27–42 will be made using 400, while reference to a specific fixture will be made using, for example, 400*a*.

Additional steps to those provided below, as desired, may also be added, and one or more of the steps may be omitted without departing from the spirit of the invention. Although a series of discrete steps are illustrated in FIGS. 27–42, the motion of the polishing apparatus 100 may be continuous and may exhibit a continuum of positions as the polishing apparatus 100 moves through the various steps.

(a) The Fixtures Are Guided to the Polishing Apparatus

Figure 27:
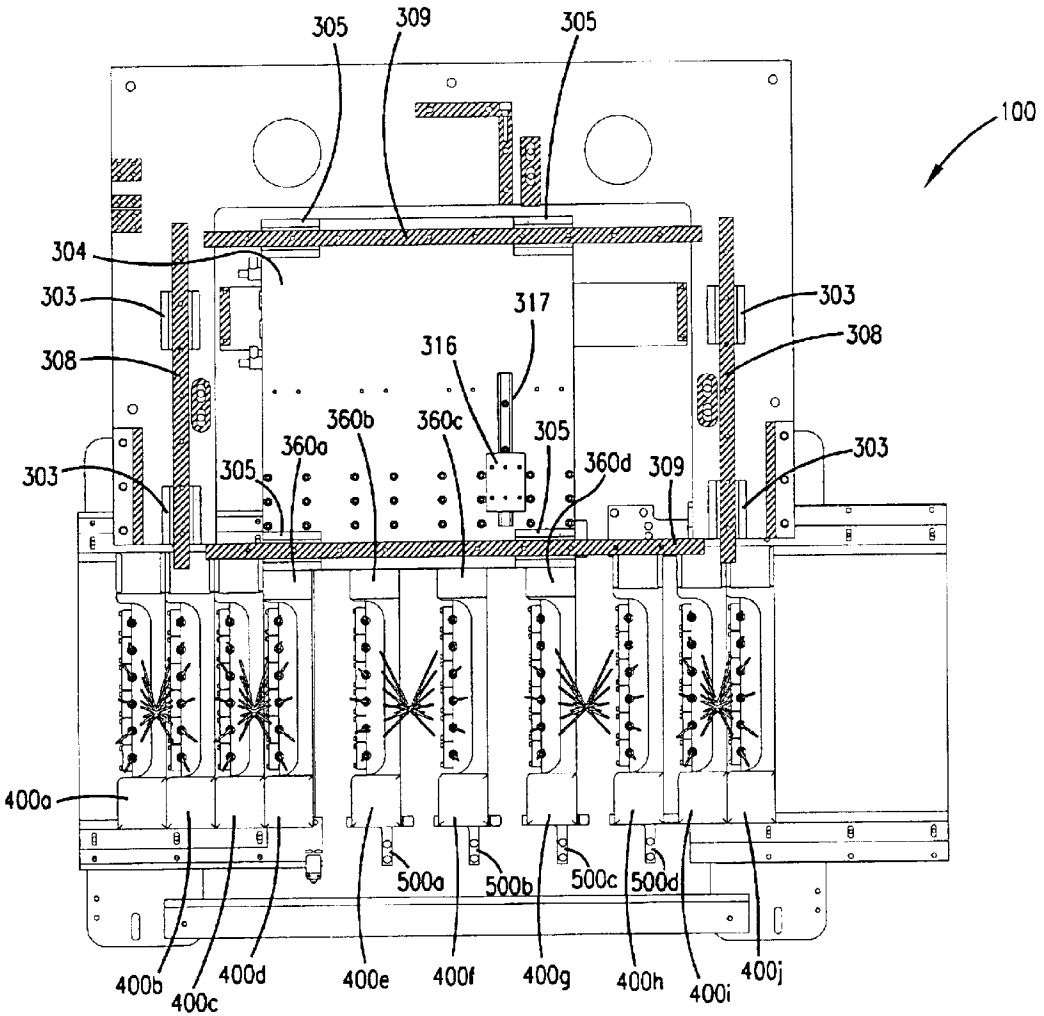
FIG. 27 is a cross-sectional view taken along section line D—D of FIG. 26 of the polishing apparatus.

Referring to FIG. 27, in a first step, one or more fixtures 400 are guided to the example polishing apparatus 100. The fixtures may be guided manually, such as by hand-feeding the fixtures into the machine, or automatically, such as by a conveyor system (not shown). In the example embodiment shown in FIG. 27, the fixtures 400*a*, 400*b*, and 400*c* are positioned at a resting station prior to polishing by the apparatus 100. In addition, the fixtures 400*i*, and 400*j* have already completed the polishing by the apparatus 100 and are awaiting transport away, either manually or automatically.

The fixtures 400*e*, 400*f*, 400*g*, and 400*h* are currently positioned over a respective polishing sub-assembly 500*a*, 500*b*, 500*c*, and 500*d* in a nested state. In this nested state, as best illustrated in FIGS. 19 and 20, the resting surfaces 435 of each fixture 400 are resting on surfaces 280 and 281 of the support system 200. The surfaces 280 and 281 fully support the fixtures 400*e*, 400*f*, 400*g*, and 400*h* so that gripper arms 360*a*, 360*b*, 360*c*, and 360*d* can fully release the fixtures 400*e*, 400*f*, 400*g*, and 400*h*.

(b) The Fixtures Are Grasped and Indexed Over One Polishing Sub-Assembly

Figure 28:
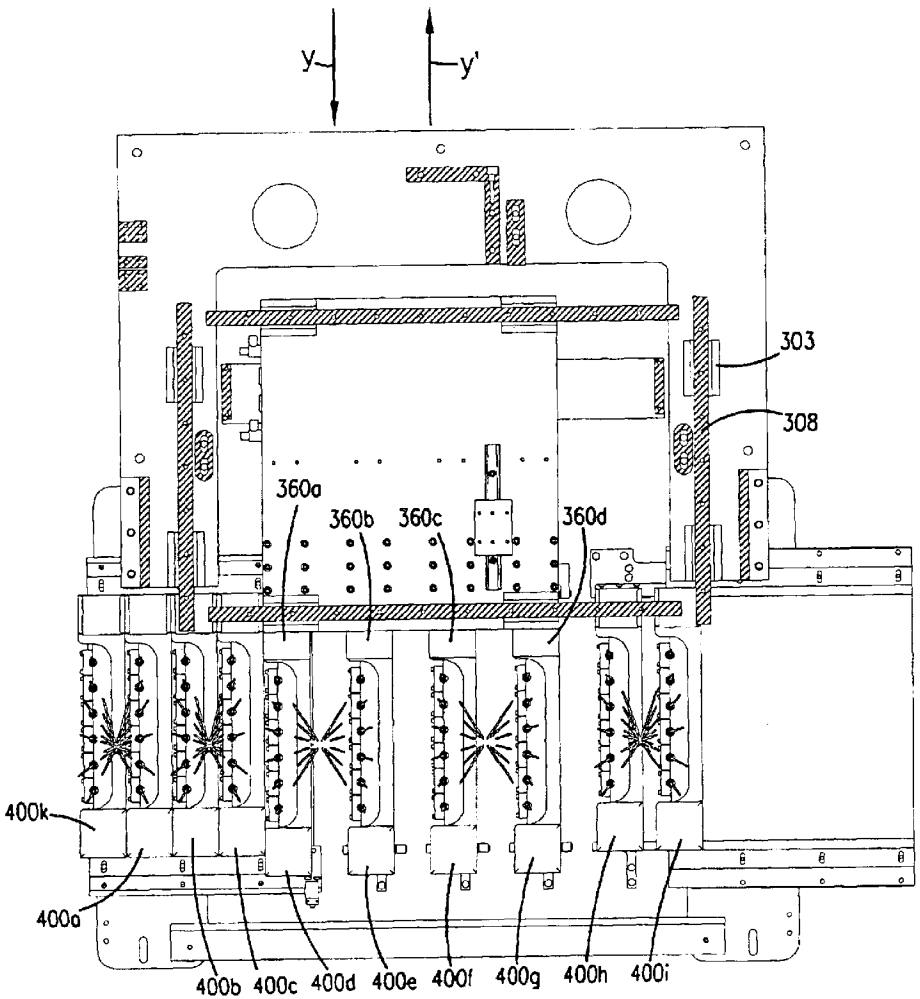
FIG. 28 is a cross-sectional view taken along section line D—D of FIG. 26 illustrating the gripper arms coupled to the fixtures and the fixtures moved to an un-nested position.

Referring now to FIGS. 28–31, a new fixture 400*k* has been added to the line of fixtures waiting to enter the polishing apparatus 100 and the fixture 400*j*, which had already completed polishing, has been removed, either manually or automatically. Referring now to FIG. 28, the fixtures 400*d,* 400*e,* 400*f,* and 400*g* have been grasped by the gripper arms 360*a,* 360*b,* 360*c,* and 360*d,* respectively, and the Y-table has been moved forward in the Y direction, thereby moving the fixtures 400*d,* 400*e,* 400*f,* and 400*g* forward. This can been seen by noting the relative positions of fixtures 400*d,* 400*e,* 400*f,* and 400*g* with respect to the other fixtures 400*k,* 400*a,* 400*b,* 400*c,* 400*h,* and 400*i.* In addition, this movement can also be noted by examining the relative positions of the bearings 303 with respect to the rails 308.

Figure 29:
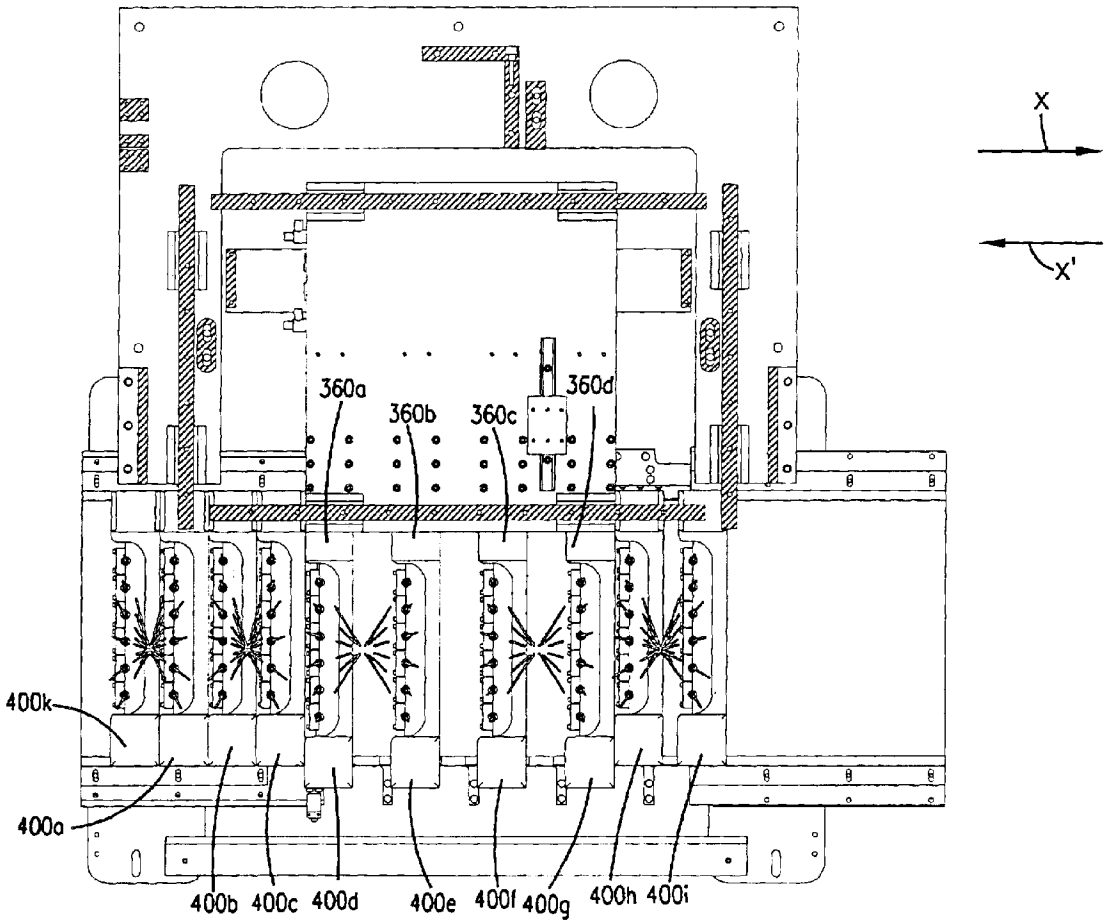
FIG. 29 is a cross-sectional view taken along section line D—D of FIG. 26 illustrating the fixtures in a pre-push position.

In FIG. 29, the grasping arms 360 have moved fixtures 400*d,* 400*e,* 400*f,* and 400*g* in the X direction towards the fixture 400*h.* In the example position shown, the fixture 400*g* is positioned immediately adjacent the fixture 400*h* in a pre-push configuration.

Figure 30:
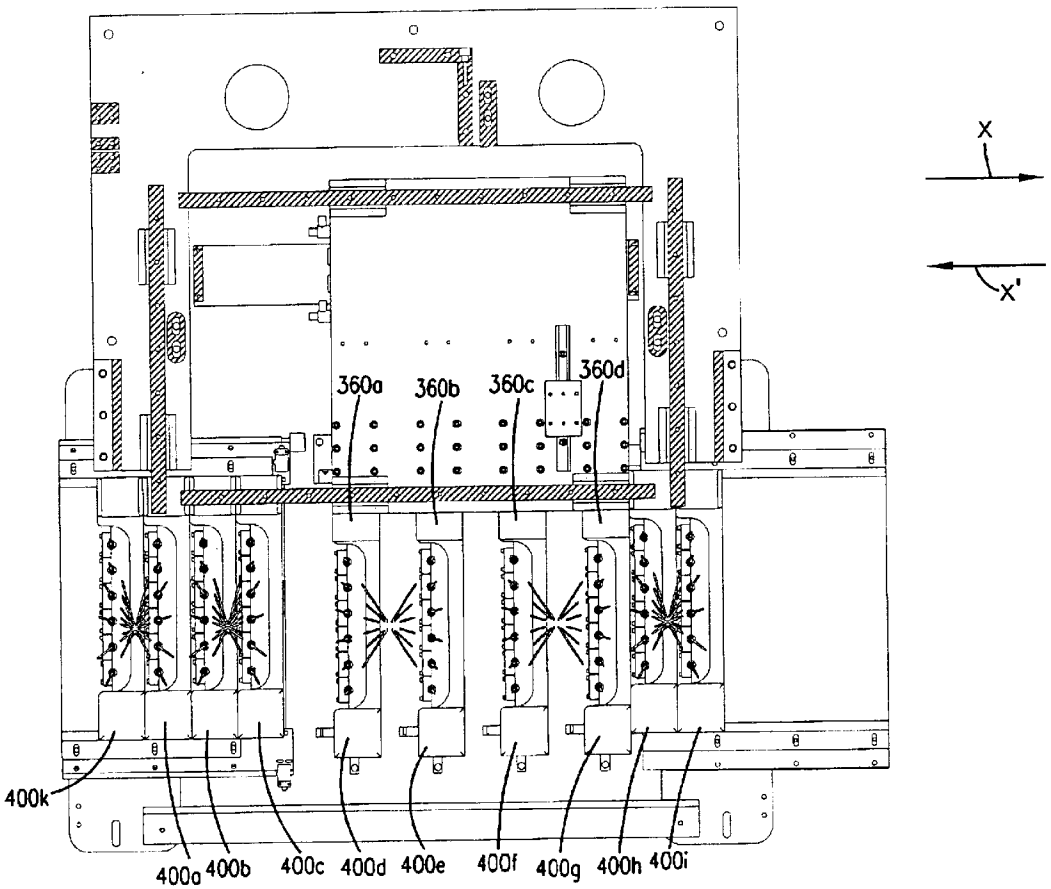
FIG. 30 is a cross-sectional view taken along section line D—D of FIG. 26 illustrating the fixtures in a post-push position.

In FIG. 30, the grasping arms 360 move the fixtures 400*d,* 400*e,* 400*f,* and 400*g* further in the X direction, causing the fixture 400*g* to contact and push the fixture 400*h,* which has already undergone polishing, further along in the X direction and out of the way of the polishing (i.e. a post-push position).

Figure 31:
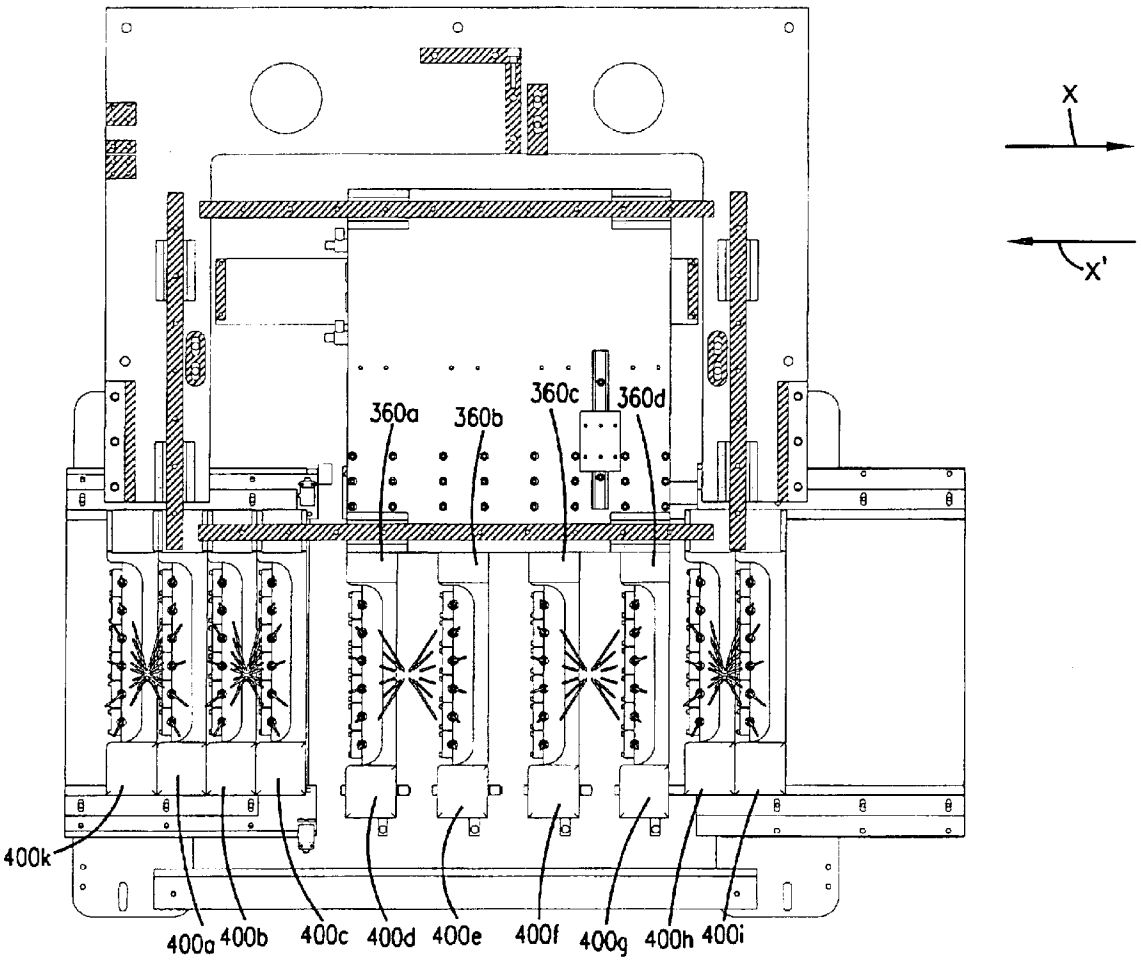
FIG. 31 is a cross-sectional view taken along section line D—D of FIG. 26 illustrating the fixtures in position to begin the polishing cycle.
Figure 31A:
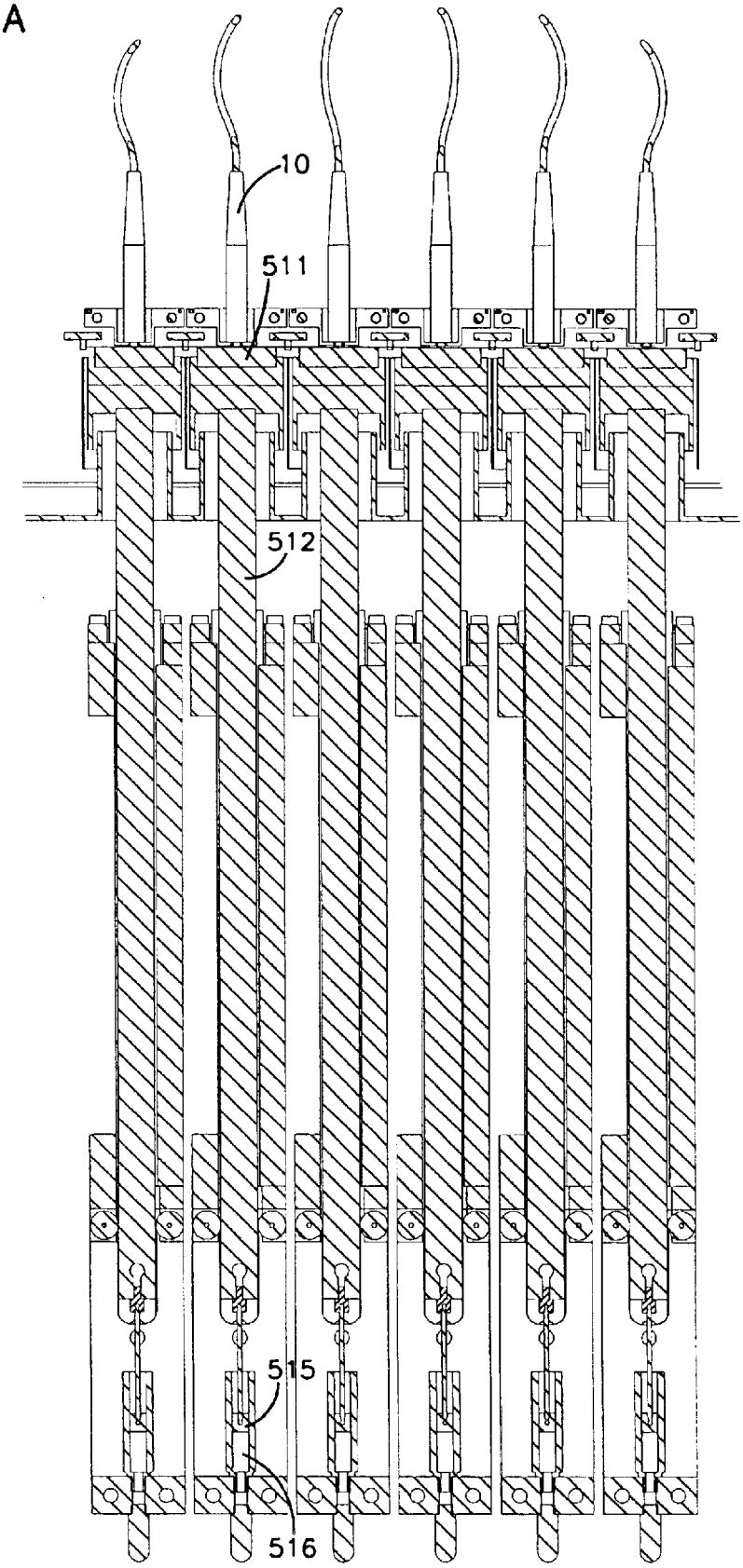
FIG. 31A is a enlarged view of a portion of the polishing sub-assembly illustrating the pad system in a raised position.

In FIG. 31, the grasping arms 360 have moved the fixtures 400*d,* 400*e,* 400*f,* and 400*g* back in the X' direction, thereby positioning the fixtures 400*d,* 400*e,* 400*f,* and 400*g* directly over the four respective polishing sub-assemblies 510*a,* 510*b,* 510*c,* and 510*d.*

Figure 31B:
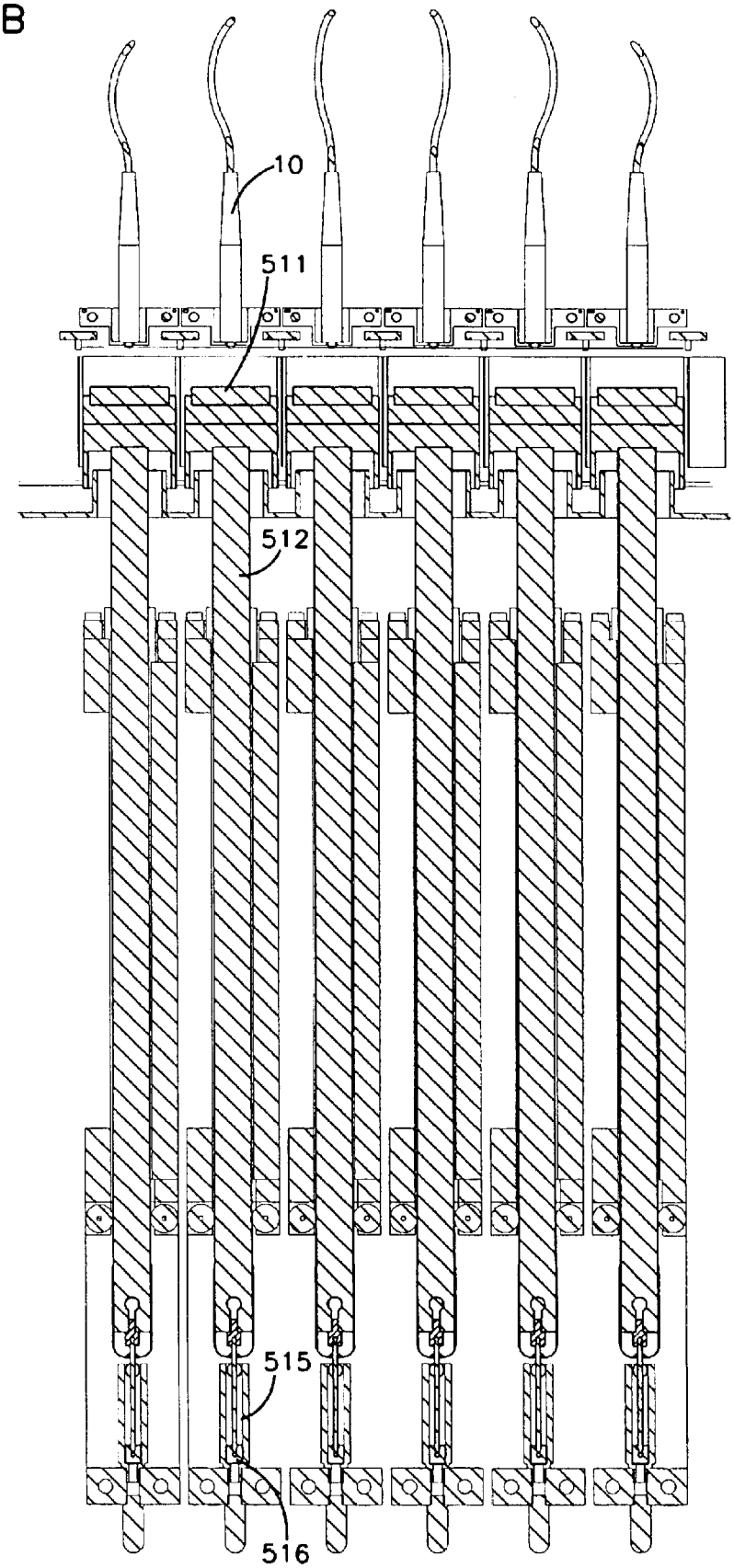
FIG. 31B is a enlarged view of a portion of the polishing sub-assembly illustrating the pad system in a lowered position.

During indexing of the fixtures, the pad system is in a lowered position, as shown in FIG. 31B.

(c) The Pad System is Raised

With the fixtures 400*d,* 400*e,* 400*f,* and 400*g* positioned over their respective polishing sub-assemblies, a plurality of pads 511 of each pad system 510 of each sub-assembly 500 are raised using air pressure (see FIG. 31A), as described above. As the pads 511 are raised, the polishing film 542, positioned to pass over the pads 511, is also raised and pressed against the end faces 13 of the ferrule 12 of each connector 10 held by each of the fixtures 400*d,* 400*e,* 400*f,* and 400*g.* As described previously, each pad 511 acts separately to apply equal force to each end face 13 of each ferrule 12. In this configuration, the polishing film 542 is held by each pad 511 and biased against each connector 10 (such as is shown in, for example, FIGS. 23 and 25).

(d) The Polishing Cycle

Referring now to FIGS. 32–39, with the fixtures 400*d,* 400*e,* 400*f,* and 400*g* positioned over the polishing sub-assemblies and the pad system 510 and polishing film 542 pressed against the end face 13 of each connector 10, polishing is commenced. In one embodiment, polishing is accomplished by moving each fixture 400 along a two-dimensional path, thus causing the end face 13 of each the connector 10 to ride along the polishing film 542 and thereby be polished.

Figure 32:
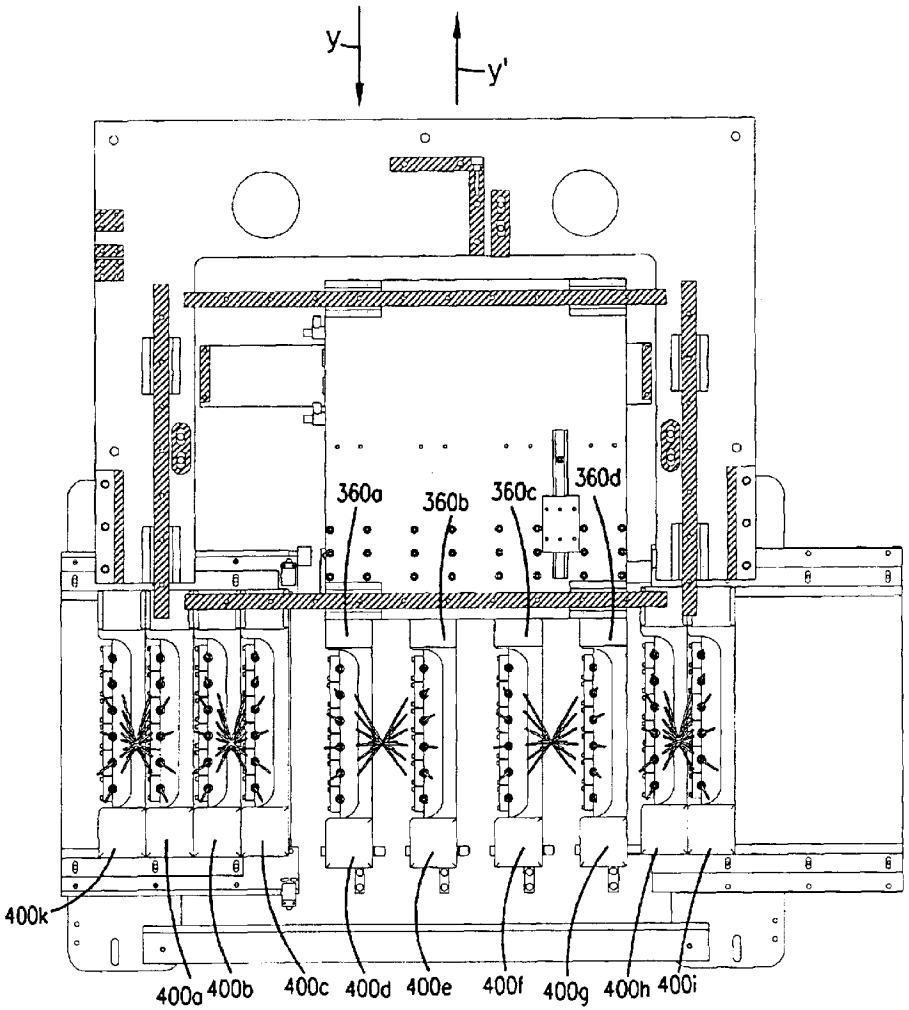
FIG. 32 is a cross-sectional view taken along section line D—D of FIG. 26 illustrating the fixtures moved in the Y' direction.
Figure 33:
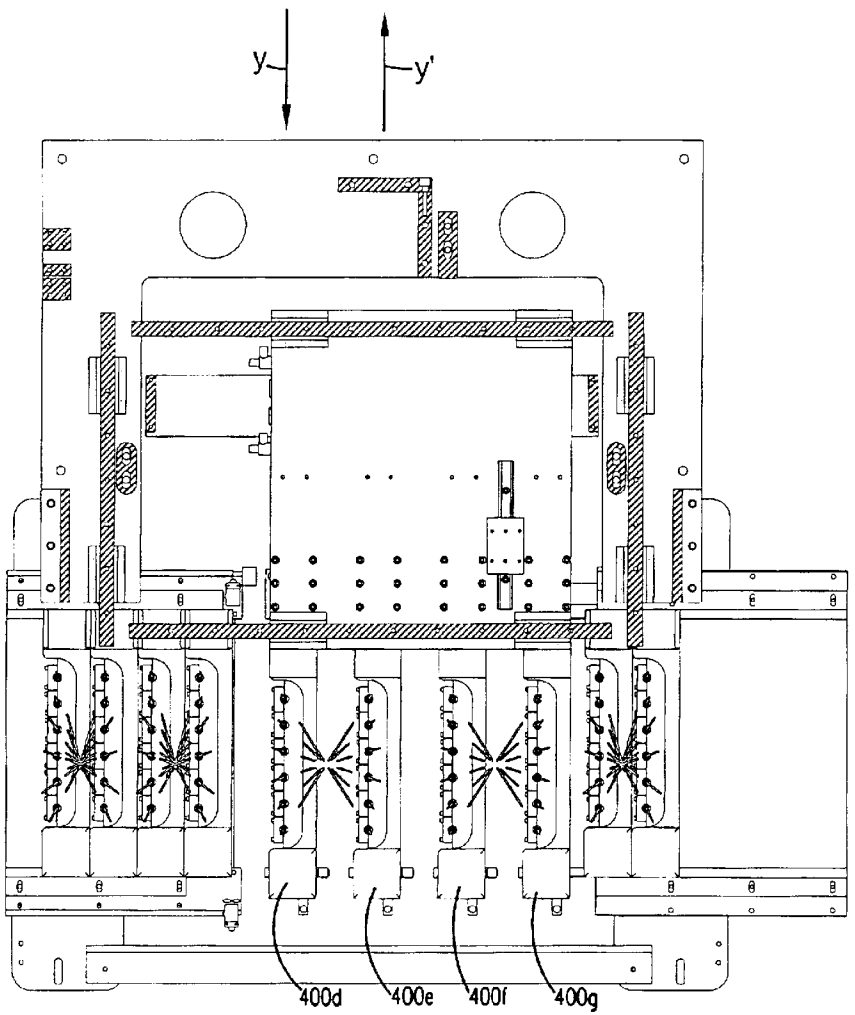
FIG. 33 is a cross-sectional view taken along section line D—D of FIG. 26 illustrating the fixtures moved back in the Y direction to their initial position.
Figure 34:
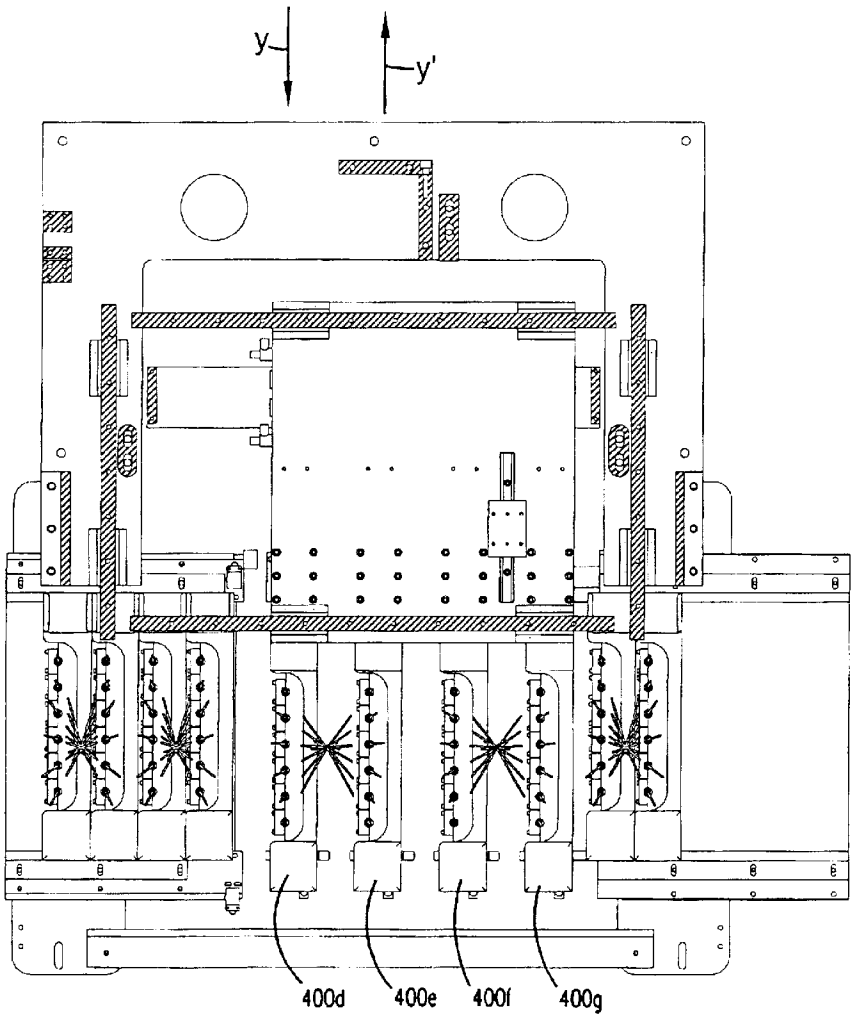
FIG. 34 is a cross-sectional view taken along section line D—D of FIG. 26 illustrating the fixtures moved in the Y direction.
Figure 35:
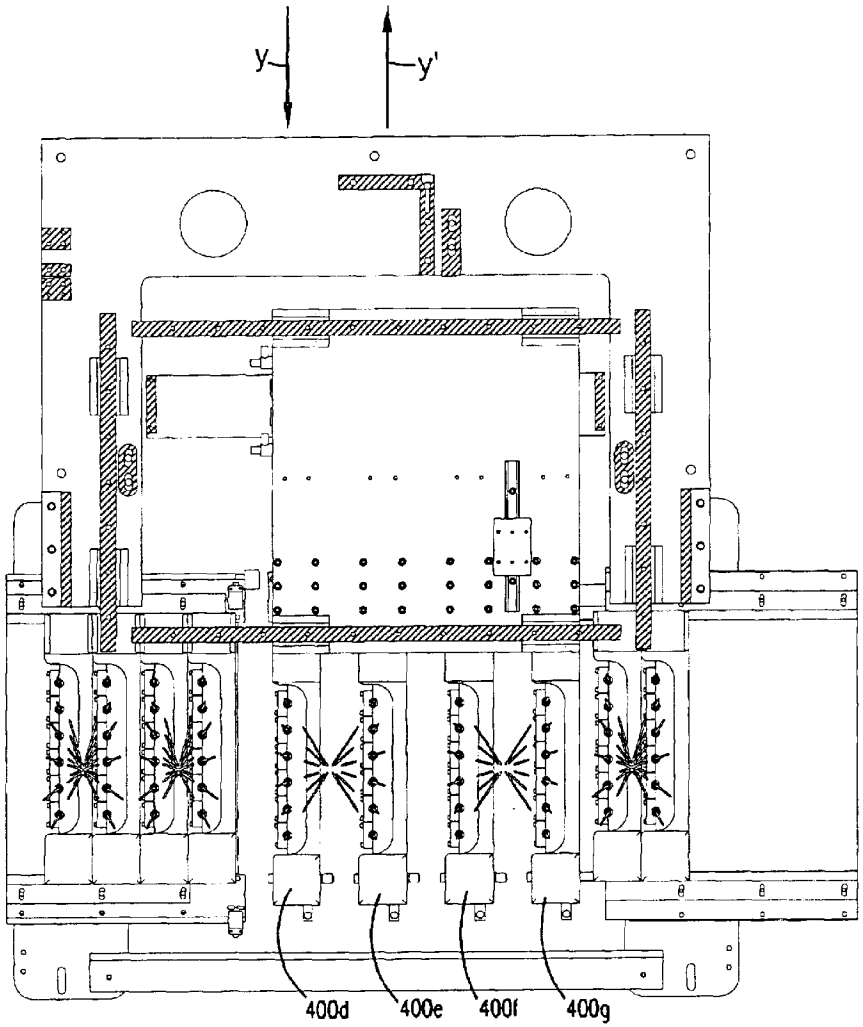
FIG. 35 is a cross-sectional view taken along section line D—D of FIG. 26 illustrating the fixtures moved back in the Y' direction to their initial position.

Referring to FIG. 32, a first step of a polishing cycle may include moving the fixtures 400*d,* 400*e,* 400*f,* and 400*g* in the Y' direction a given amount. In the example embodiment, this amount is approximately ½ inch, although other amounts can also be used as desired. In FIG. 33, the fixtures 400*d,* 400*e,* 400*f,* and 400*g* are moved in the Y direction back to their initial position. In FIGS. 34 and 35, the fixtures 400*d,* 400*e,* 400*f,* and 400*g* are moved first in the Y direction a given amount (for example, ½ inch) (see FIG. 34) and then are moved back in the Y' direction to their initial position (see FIG. 35).

Figure 36:
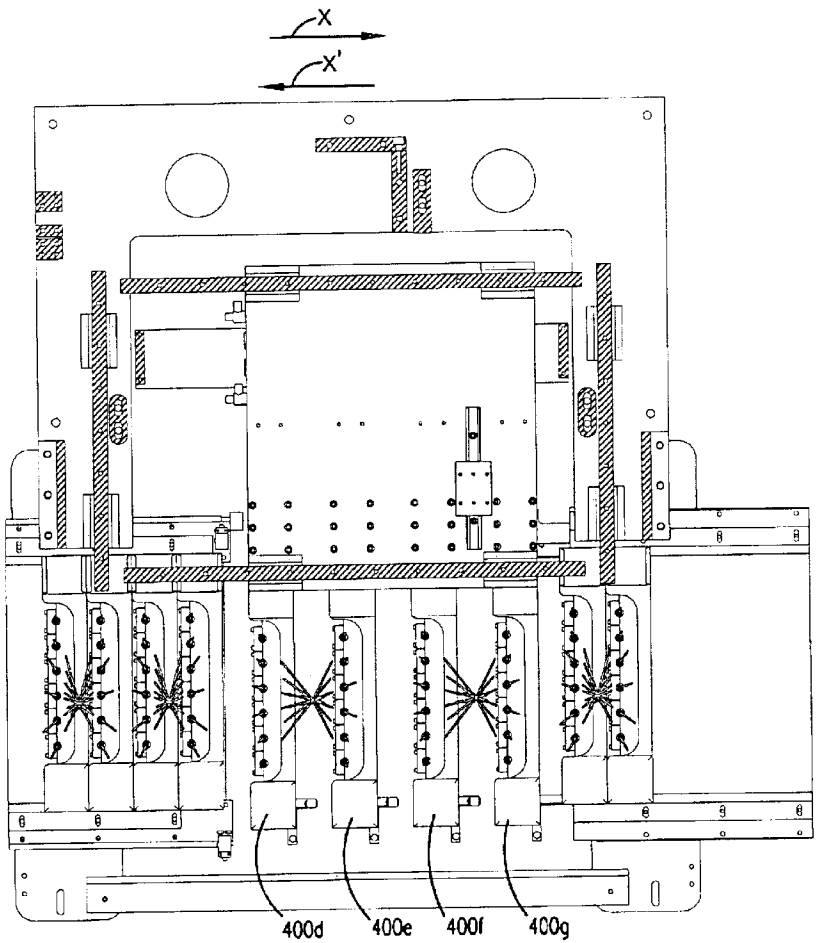
FIG. 36 is a cross-sectional view taken along section line D—D of FIG. 26 illustrating the fixtures moved in the X' direction.
Figure 37:
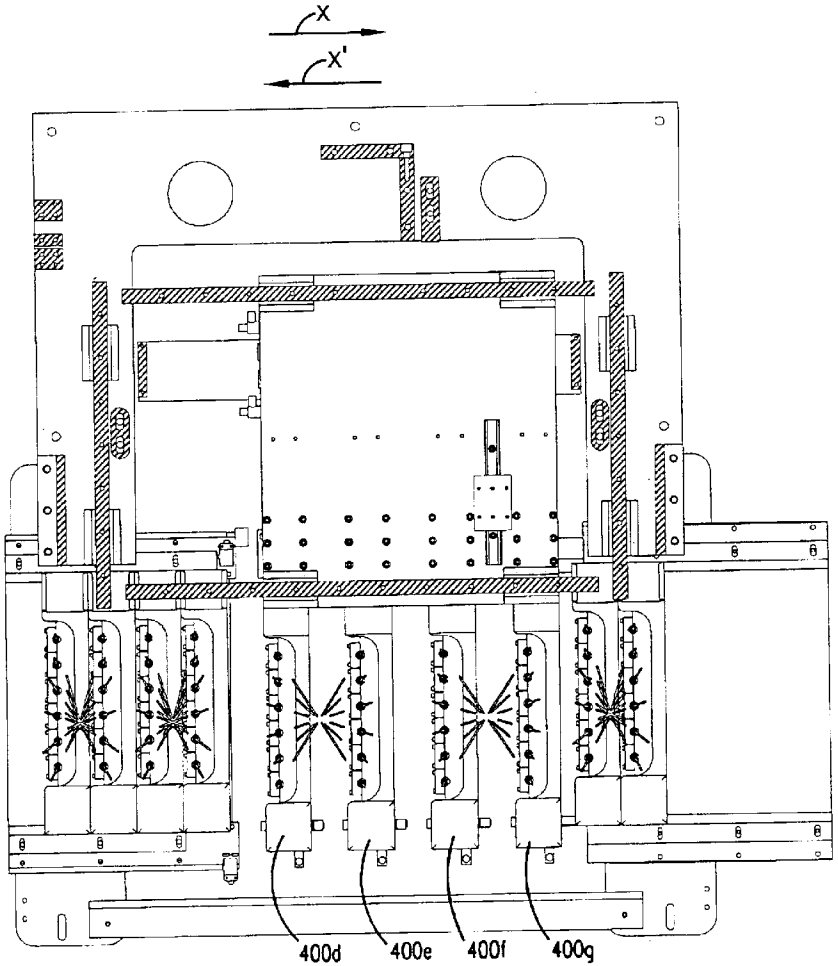
FIG. 37 is a cross-sectional view taken along section line D—D of FIG. 26 illustrating the fixtures moved back in the X direction to their initial position.
Figure 38:
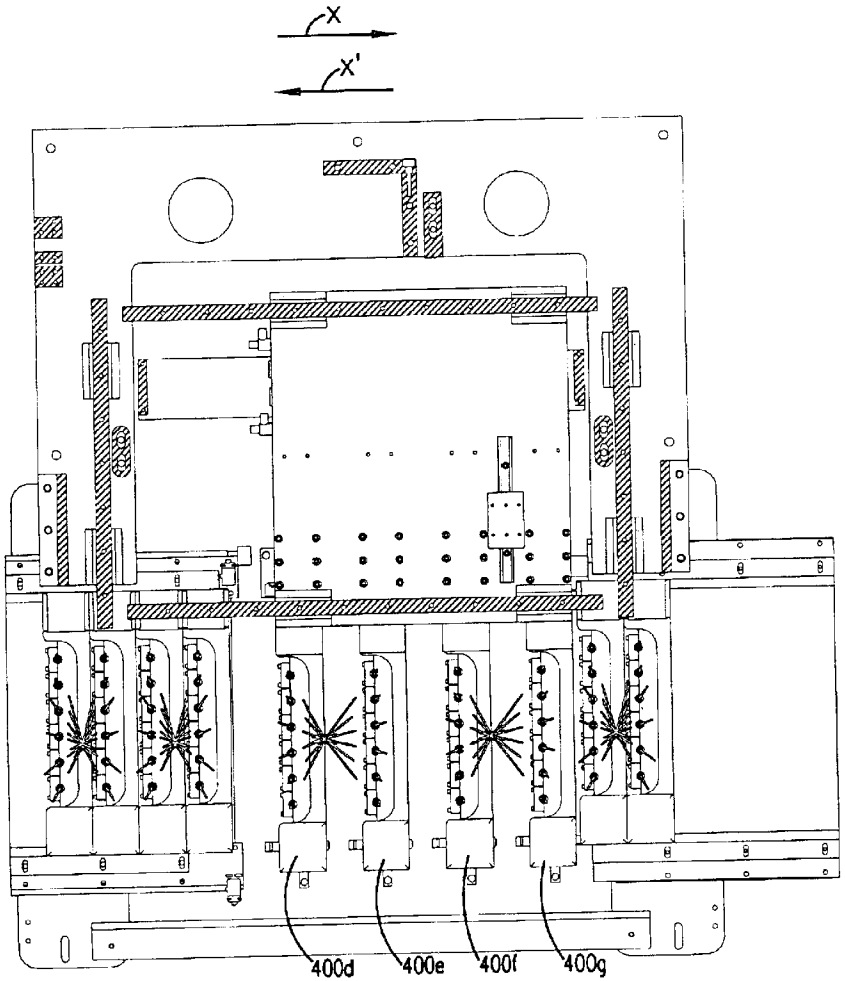
FIG. 38 is a cross-sectional view taken along section line D—D of FIG. 26 illustrating the fixtures moved in the X direction.
Figure 39:
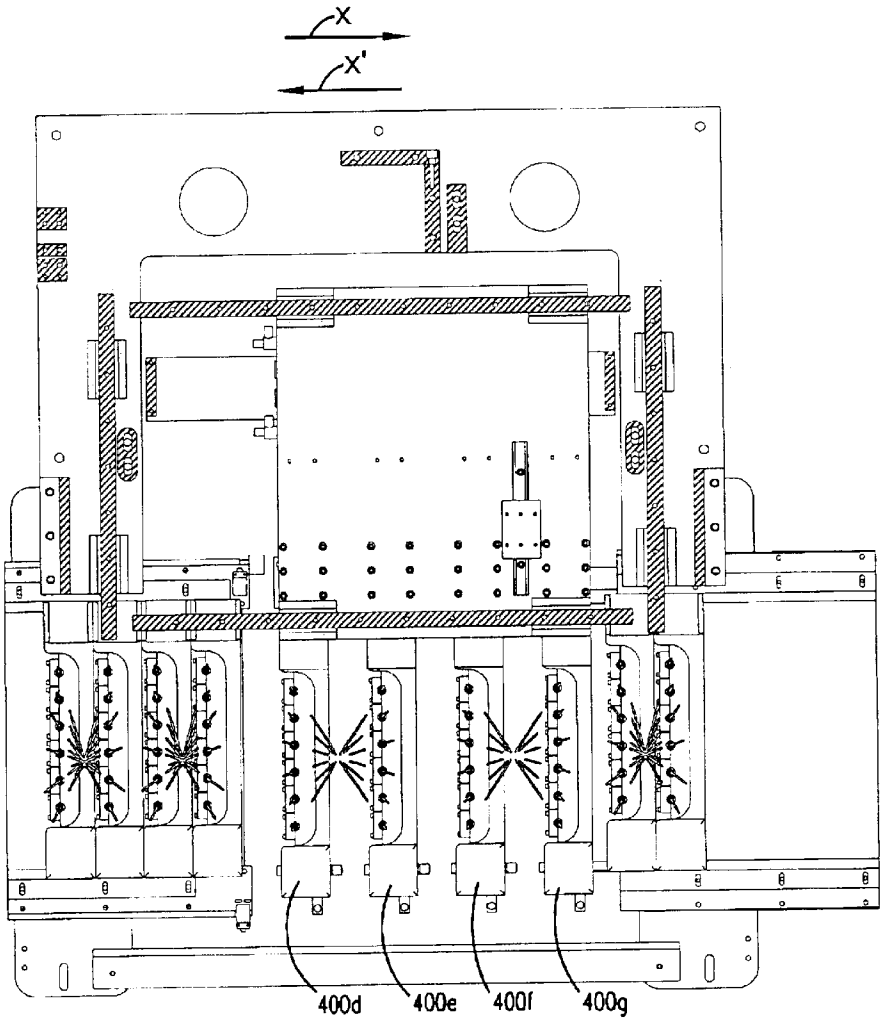
FIG. 39 is a cross-sectional view taken along section line D—D of FIG. 26 illustrating the fixtures moved back in the X' direction to their initial position.

In FIGS. 36 and 37, the fixtures 400*d,* 400*e,* 400*f,* and 400*g* are moved first in the X' direction a given amount (see FIG. 36) and then are moved back in the X direction to their initial position (see FIG. 37). In FIGS. 38 and 39, the fixtures 400*d,* 400*e,* 400*f,* and 400*g* are moved first in the X direction a given amount (see FIG. 38) and then are moved back in the X' direction to their initial position (see FIG. 39).

The movement illustrated in FIGS. 32–39 can constitute a single polishing cycle. This polishing cycle can be repeated a number of times, as desired, to polish the end face 13 of each of the plurality of connectors 10 held in each fixture 400. In addition, other sequences and cycles are also possible. In an example embodiment, the polishing cycle is a combination of motion in the X and Y directions following a spiraling circular path at a constant speed. The shape of the path is fully programmable, as are the speeds, accelerations, and directions of the polishing cycle. Furthermore, the pad force and the fluid injection can also be controlled and altered during the polishing cycle. A polishing cycle can be selected, as desired, to polish each connector 10 to meet certain specifications such as, for example, radius of curvature, apex offset, fiber height, surface finish, insertion loss, and return loss.

(e) The Pad System is Lowered and the Polishing Film is Indexed

When the polishing cycle is complete, the pad system 510 including the plurality of pads 511 are lowered (FIG. 31B), and the polishing film 542 also lowers with the pads 511. The polishing film 542 can then be indexed by the pincher roller 548 so that fresh polishing film is positioned over the pad system 510 for the next polishing cycle.

(f) The Fixtures are Docked in the Nest

Figure 40:
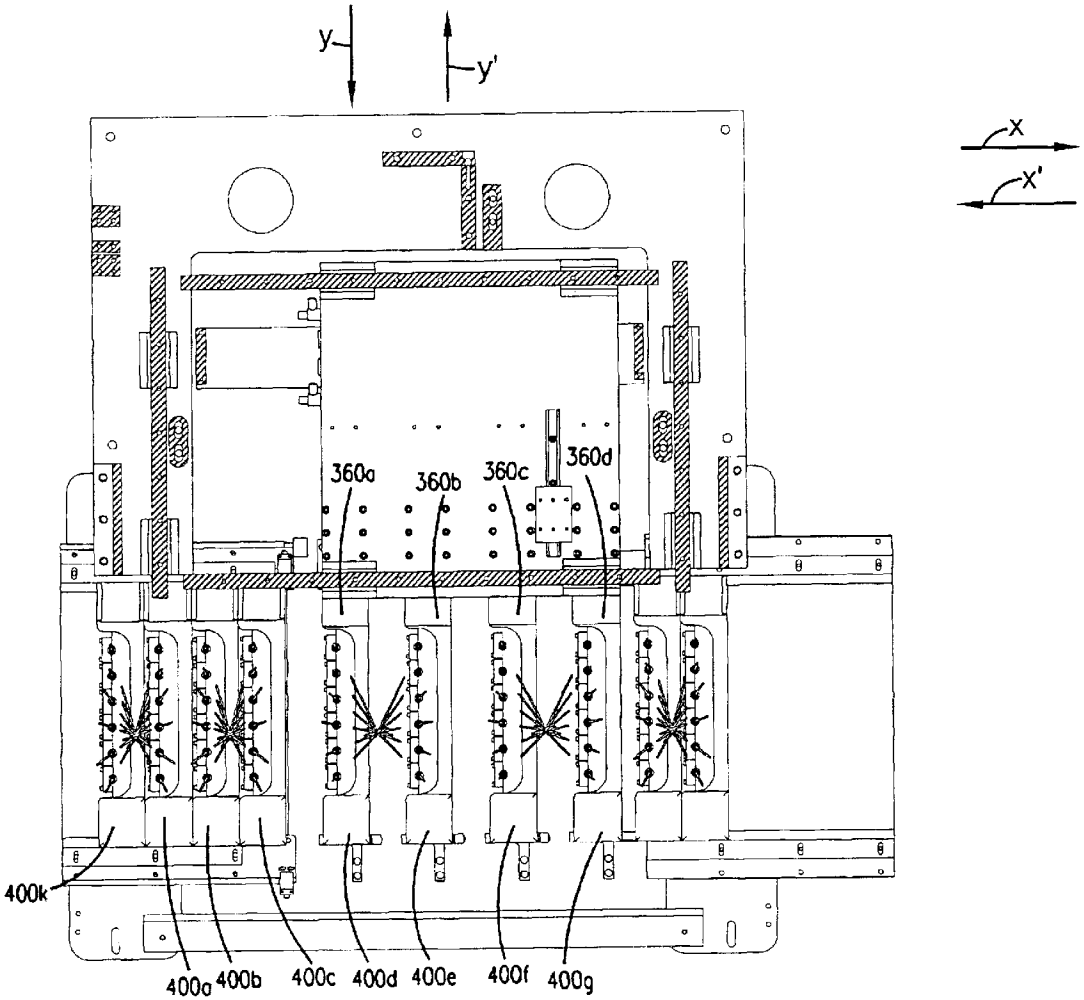
FIG. 40 is a cross-sectional view taken along section line D—D of FIG. 26 illustrating the fixtures in the nested position.

Concurrent with or subsequent to the previous step, the fixtures 400*d,* 400*e,* 400*f,* and 400*g* are moved in the Y' direction. The gripper arms 360 then release each fixture, thereby docking the fixtures in the nest as shown in FIG. 40.

(g) The Gripper Arms are Indexed

Figure 41:
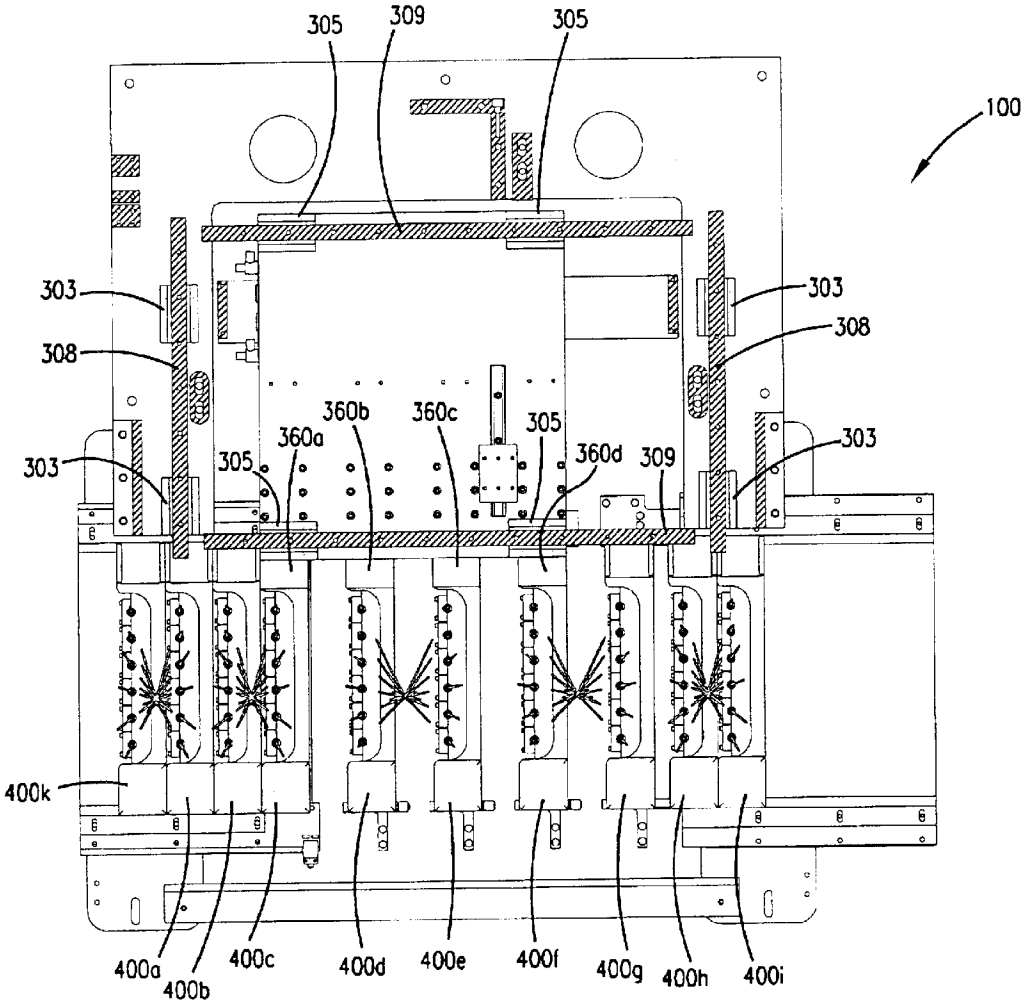
FIG. 41 is a cross-sectional view taken along section line D—D of FIG. 26 illustrating the gripper arms indexed in the X' direction.

The gripper arms 360 (without the fixtures) are then indexed in the X' direction so that the gripper arm 360*a* is positioned to grip the fixture 400*c,* the gripper arm 360*b* is positioned to grip the fixture 400*d,* the gripper arm 360*c* is positioned to grip the fixture 400*e,* and gripper arm 360*d* is positioned to grip the fixture 400*f,* as is shown in FIG. 41. The gripper arms 360*a,* 360*b,* 360*c,* and 360*e* then grip the fixtures 400*c,* 400*d,* 400*e,* and 400*f,* respectively.

(h) The Rinsing System is Activated

If the rinsing system 580 is provided, it is activated so that de-ionized water flows through and saturates the roller 582.

(i) The Fixtures Are Indexed Over One Polishing Sub-Assembly

Figure 42:
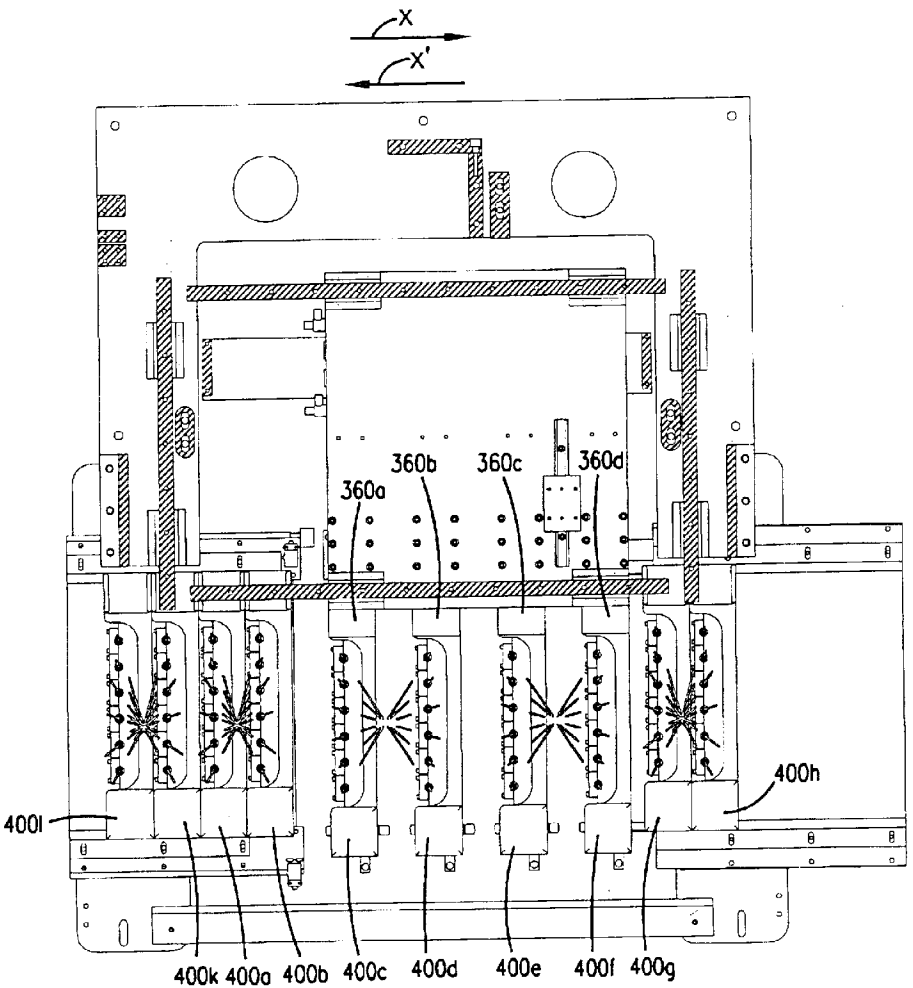
FIG. 42 is a cross-sectional view taken along section line D—D of FIG. 26 illustrating the fixtures indexed in the X direction one polishing sub-assembly.

Similar to step (b) described above, the fixtures 400*c,* 400*d,* 400*e,* and 400*f* are then indexed in the X direction one polishing sub-assembly 500, as shown in FIG. 42. As each fixture 400 passes between adjacent polishing sub-assemblies 500, the end face 13 of the ferrule 12 of each connector 10 is caused to contact the roller 582, thereby removing any debris for each end face 13. In one embodiment, each fixture 400 is passed back and forth over the roller 582 multiple times to further clean the end faces 13. Once the fixtures have passed over the roller 582, the flow of de-ionized water into the rinsing roller 582 is terminated.

With the fixtures 400*c,* 400*d,* 400*e,* and 400*f* positioned as shown in FIG. 42, a new polishing cycle, such as that described in steps (c)–(f) above, can be initiated.

Having described aspects and example embodiments of the present invention, modifications and equivalents of the disclosed concepts may readily occur to one skilled in the art. For example, while the fixtures illustrated herein are configured to hold connectors and associated ferrules in a vertically upright orientation, it will be appreciated that the fixtures could also be oriented so as to each hold a ferrule at an oblique angle relative to a polishing surface. However, it is intended that such modifications and equivalents be included within the scope of the claims that are appended hereto.

What is claimed is:

1. A fiber optic polishing apparatus comprising:

a support system;

a polishing sub-assembly coupled to the support system including a plurality of pads, wherein each pad of the plurality of pads travels independently in a vertical direction;

a fixture including a plurality of connector locations configured to hold the plurality of fiber optic connectors, the fixture being positioned adjacent to the plurality of pads so that an end surface of each of the plurality of fiber optic connectors is held in contact with a corresponding pad of the plurality of pads; and a drive mechanism coupled to the support system to move the fixture in at least two-dimensions to polish the end surface of each of the plurality of fiber optic connectors.

2. The fiber optic polishing apparatus of claim 1, further comprising a controller coupled to the drive mechanism to control movement of the drive mechanism.

3. The fiber optic polishing apparatus of claim 2, wherein the drive mechanism moves the fixture in a pre-determined pattern.

4. The fiber optic polishing apparatus of claim 1, wherein the plurality of pads includes one pad for each of the plurality of connector locations in the fixture.

5. The fiber optic polishing apparatus of claim 4, further comprising a web polishing film configured to pass over the plurality of pads, the web polishing film being indexed by a pincher roller.

6. The fiber optic polishing apparatus of claim 5, wherein each pad of the plurality of pads travels independently vertically to bias the web polishing film against each of the plurality of fiber optic connectors in the fixture.

7. The fiber optic polishing apparatus of claim 5, further comprising:

a fluid injection module configured to direct fluid onto atop surface of a portion of the web polishing film positioned over the plurality of pads; and a rinsing module including a pressurized fluid-saturated roller positioned adjacent the plurality of pads to rub against a face of each of the plurality of fiber optic connectors to remove debris.

8. The fiber optic polishing apparatus of claim 1, wherein the fixture is a first fixture and the polishing sub-assembly is a first polishing sub-assembly, and wherein the apparatus further comprises:

a second polishing sub-assembly coupled to the support system including a plurality of pads; and a second fixture including a plurality of connector locations configured to hold a plurality of fiber optic connectors, wherein the second fixture is positioned adjacent to the plurality of pads of the second polishing sub-assembly so that an end surface of each of the plurality of fiber optic connectors is held in contact with a corresponding pad of the plurality of pads at a predetermined angle.

9. The fiber optic polishing apparatus of claim 8, wherein the drive mechanism simultaneously moves the first and second fixtures to polish the end surface of each of the plurality of fiber optic connectors held in the first fixture to a first polished state and to polish the end surface of each of the plurality of fiber optic connectors held in the second fixture to a second polished state.

10. The fiber optic polishing apparatus of claim 1, wherein each pad of the plurality of pads is aligned in a plane with respect to each other pad of the plurality of pads to create a row of pads.

11. A fiber optic polishing apparatus comprising:

a support system;

a fixture attached to the support system including a plurality of connector locations configured to bold a plurality of fiber optic connectors; and a polishing sub-assembly coupled to the support system including a plurality of pads each corresponding to a fiber optic connector from the plurality of connectors, wherein each of the plurality of pads travels independently to exert a desired force against an end face of each corresponding fiber optic connector of the plurality of fiber optic connectors.

12. The fiber optic polishing apparatus of claim 11, further comprising a web polishing film configured to pass over the plurality of pads, the web polishing film being indexed by a pincher roller.

13. The fiber optic polishing apparatus of claim 12, further comprising:

a fluid injection module configured to direct fluid onto a top surface of a portion of the web polishing film positioned over the plurality of pads; and a rinsing module including a pressurized fluid-saturated roller positioned adjacent the plurality of pads to rub against a face of each of the plurality of fiber optic connectors to remove debris.

14. The fiber optic polishing apparatus of claim 11, wherein the fixture is a first fixture and the polishing sub-assembly is a first polishing sub-assembly, and wherein the apparatus further comprises:

a second polishing sub-assembly coupled to the support system including a plurality of pads; and a second fixture including a plurality of connector locations configured to hold a plurality of fiber optic connectors, wherein the second fixture is positioned adjacent to the plurality of pads of the second polishing sub-assembly so that an end surface of each of the plurality of fiber optic connectors is held in contact with a corresponding pad of the plurality of pads at a predetermined angle.

15. The fiber optic polishing apparatus of claim 11, wherein each pad of the plurality of pads is aligned in a plane with respect to each other pad of the plurality of pads to create a row of pads.

* * * * *

UNITED STATES PATENT AND TRADEMARK OFFICE

CERTIFICATE OF CORRECTION

PATENT NO. : 6,918,816 B2
DATED : July 19, 2005
INVENTOR(S) : Bianchi

It is certified that error appears in the above-identified patent and that said Letters Patent is hereby corrected as shown below:

Column 13,
Line 44, “atop surface” should read -- a top surface --.

Signed and Sealed this

Twenty-fifth Day of October, 2005

JON W. DUDAS
*Director of the United States Patent and Trademark Office*